US010408170B2

(12) United States Patent
Kobayashi et al.

(10) Patent No.: US 10,408,170 B2
(45) Date of Patent: Sep. 10, 2019

(54) EGR COOLER BYPASS VALVE

(71) Applicant: AISAN KOGYO KABUSHIKI KAISHA, Obu-shi, Aichi-ken (JP)

(72) Inventors: Masahiro Kobayashi, Toyohashi (JP); Mamoru Yoshioka, Nagoya (JP); Mitsuru Takeuchi, Kariya (JP); Musashi Suzuki, Nagoya (JP); Shinji Kawai, Gifu (JP); Naruto Ito, Nisshin (JP)

(73) Assignee: AISAN KOGYO KABUSHIKI KAISHA, Obu-shi (JP)

( * ) Notice: Subject to any disclaimer, the term of this patent is extended or adjusted under 35 U.S.C. 154(b) by 0 days.

(21) Appl. No.: 15/987,411

(22) Filed: May 23, 2018

(65) Prior Publication Data

US 2019/0003427 A1 Jan. 3, 2019

(30) Foreign Application Priority Data

Jun. 28, 2017 (JP) ..... 2017-125978

(51) Int. Cl.
*F02M 26/26* (2016.01)

(52) U.S. Cl.
CPC ..... *F02M 26/26* (2016.02)

(58) Field of Classification Search
CPC ..... F02M 26/26
See application file for complete search history.

(56) References Cited

U.S. PATENT DOCUMENTS 7,661,415 B2 * 2/2010 Nakamura ..... F28D 9/0025 123/568.12

FOREIGN PATENT DOCUMENTS

JP 2009-250096 A 10/2009
JP 2016-166573 A 9/2016

* cited by examiner

*Primary Examiner* — Hieu T Vo
(74) *Attorney, Agent, or Firm* — Oliff PLC

(57) ABSTRACT

In a casing, a cooler valve element is placed in a cooler flow passage, while a bypass valve element is placed in a bypass flow passage. The cooler valve element is adjacent and fixed to a first shaft end portion of a valve shaft. The bypass valve element is adjacent and fixed to a second shaft end portion of the valve shaft. A first bearing is provided between the casing and the first shaft end portion and a second bearing is provided between the casing and the second shaft end portion. A first seal member is placed, adjacent to the first bearing, and a second seal member is placed adjacent to a second bearing. A driven gear is fixed to a leading end of the first shaft end portion. The first bearing consists of a rolling bearing and the second bearing is formed of a slid bearing.

3 Claims, 15 Drawing Sheets

EGR COOLER BYPASS VALVE

CROSS-REFERENCE TO RELATED APPLICATIONS

This application is based upon and claims the benefit of priority from the prior Japanese Patent Application No. 2017-125978 filed on Jun. 28, 2017, the entire contents of which are incorporated herein by reference.

BACKGROUND

Technical Field

This disclosure is related to an EGR cooler bypass valve to be used together with an EGR cooler for cooling EGR gas and a bypass passage bypassing the EGR cooler and configured to simultaneously adjust a flow rate of EGR gas passing through the EGR cooler and a flow rate of EGR gas passing through the bypass passage.

Related Art

As the above type of technique, conventionally, there has been known a technique disclosed for example in Patent Document 1 (a valve unit of an EGR device) listed below. This Patent Document 1 discloses a parallel-flow type EGR cooler unit placed at some place in an EGR passage. The EGR cooler unit is provided with a cooler passage, a bypass passage bypassing the cooler passage, a cooler casing including a gas inlet part provided on an inlet side of the cooler passage and an inlet side of the bypass passage, a valve unit provided on an outlet side of the cooler passage and an outlet side of the bypass passage, and a gas outlet part provided on an outlet side of the valve unit. In the cooler passage, a heat exchanger is provided, through which engine cooling water flows. In this EGR cooler unit, the cooler passage and the heat exchanger constitute the EGR cooler. The gas inlet part and the gas outlet part are each connected to an EGR passage.

Herein, this valve unit is used together with the EGR cooler and configured to simultaneously adjust a flow rate of EGR gas passing through the EGR cooler and a flow rate of EGR gas passing through the bypass passage. The valve unit is provided with a valve casing. The valve casing includes a cooler flow passage communicated with the cooler passage and a bypass flow passage communicated with the bypass passage, and the cooler flow passage and the bypass flow passage are separated by a partition wall. In the cooler flow passage, a cooler valve element is rotatably provided. In the bypass flow passage, a bypass valve element is rotatably provided. These valve elements are butterfly valve elements fixed to a single valve shaft with a phase displacement from each other. When the cooler valve element is placed in a fully closed position, the bypass valve element is placed in a fully opened position to allow EGR gas to flow through the bypass passage and the bypass flow passage. On the other hand, when the cooler valve element is placed in a fully opened position, the bypass valve element is placed in a fully closed position to allow EGR gas to flow through the cooler passage and the cooler flow passage. Herein, even though Patent Document 1 does not explicitly disclose, it is conceived that both shaft end portions of the valve shaft are individually supported by a valve casing through corresponding bearings. Further, it is considered that one of the shaft end portions is drivingly connected to an actuator such as a DC motor through a speed reducing mechanism including a driven gear and others.

RELATED ART DOCUMENTS

Patent Documents

Patent document 1: Japanese unexamined patent application publication No. 2009-250096

SUMMARY

Technical Problems

Meanwhile, in the valve unit disclosed in Patent Document 1, high-temperature EGR gas having not been cooled by the EGR cooler flows in the bypass flow passage, while EGR gas having been cooled by the EGR cooler flows in the cooler flow passage. However, when a large amount of EGR gas flows in the EGR cooler, the EGR gas may not be cooled sufficiently by the EGR cooler and such an insufficiently cooled EGR gas may flow in the cooler flow passage. This may cause heat damage due to overheating of the valve shaft and others. For instance, on the valve shaft, not only the bearing but also a seal member including a resin or rubber element is provided between the valve shaft and the valve casing in order to protect the bearing from foreign matters and water/moisture. The overheating of the valve shaft may affect the heat resistance and the function of this seal member. To address this defect, it is conceived to enhance the heat radiation property from the valve shaft to the valve casing or reduce the heat transfer from the valve shaft to the seal member. Moreover, since the driven gear is fixed to the one shaft end portion of the valve shaft to rotate the valve shaft, the relevant shaft end portion needs to be precisely and stably rotated. This is to smoothen meshing of the driven gear with another gear to reduce wear of the driven gear. When the driven gear is made of resin, it is necessary to protect this driven gear from heat damage.

The present disclosure has been made to address the above problems and has a purpose to provide an EGR cooler bypass valve capable of enhancing the heat resistance of a seal member against heat damage by EGR gas and also drivingly connect a valve shaft to a speed reducing mechanism with precision and stability.

Means of Solving the Problems

To achieve the above-mentioned purpose, one aspect of the present disclosure provides an EGR cooler bypass valve to be used together with an EGR cooler for cooling EGR gas and a bypass passage bypassing the EGR cooler, the EGR cooler bypass valve being configured to simultaneously adjust a flow rate of the EGR gas passing through the EGR cooler and a flow rate of the EGR gas passing through the bypass passage, the EGR cooler bypass valve including: a casing including a cooler flow passage through which the EGR gas having passed through the EGR cooler flows, and a bypass flow passage through which the EGR gas having passed through the bypass passage flows, the casing being configured such that the cooler flow passage and the bypass flow passage are separated by a partition wall; a valve shaft placed in the casing so that the valve shaft extends across the cooler flow passage, the bypass flow passage, and the partition wall, and the valve shaft including a first shaft end portion and a second shaft end portion; a cooler valve element placed in the cooler flow passage and provided integral with the valve shaft; a bypass valve element placed in the bypass flow passage and provided integral with the valve shaft; a first bearing provided between the casing and the first shaft end portion and configured to rotatably support the first shaft end portion; a second bearing provided between the casing and the second shaft end portion and configured to rotatably support the second shaft end portion; a first seal member placed near the first bearing and configured to seal between the first shaft end portion and the casing; a second seal member placed near the second bearing and configured to seal between the second shaft end portion and the casing; and a driven gear fixed to a leading end of the first shaft end portion to rotate the valve shaft, the driven gear constituting a speed reducing mechanism, the EGR cooler bypass valve being configured to rotate the valve shaft through the driven gear to open and close the cooler valve element and the bypass valve element, wherein the cooler flow passage and the cooler valve element are placed adjacent to the first shaft end portion and the bypass flow passage and the bypass valve element are placed adjacent to the second shaft end portion, the first bearing consists of a rolling bearing to precisely support rotation of the first shaft end portion, and the second bearing consists of a slide bearing to enhance heat radiation from the second shaft end portion to the casing.

According to the above configuration, in the casing, the EGR gas having passed through the EGR cooler and having been cooled therein flows through the cooler flow passage, while the EGR gas having passed through the bypass passage and having not been cooled flows through the bypass flow passage. The cooler valve element placed in the cooler flow passage is placed adjacent to the first shaft end portion, and the bypass valve element placed in the bypass flow passage is placed adjacent to the second shaft end portion. Accordingly, the amount of heat transferred from the EGR gas flowing through the cooler flow passage to the first shaft end portion is smaller than the amount of heat transferred from the EGR gas flowing through the bypass flow passage to the second shaft end portion. Thus, the temperature of the first shaft end portion is relatively low, so that the first seal member is prevented from becoming overheated. Further, the driven gear is fixed to the leading end of the first shaft end portion and the first bearing supporting this first shaft end portion consists of a rolling bearing. Therefore, the rotation of the first shaft end portion as well as the driven gear is precisely supported by the first bearing. In addition, the second bearing supporting the second shaft end portion consists of a slide bearing. Accordingly, the amount of heat released from the second shaft end portion to the casing is increased, and thus the temperature of the second shaft end portion is relatively low, so that the second seal member is prevented from becoming overheated.

According to the above aspect, the first and second seal members can be prevented from thermal degradation due to heat damage by EGR gas and the valve shaft can be drivingly connected to the speed reducing mechanism with precision and stability.

DETAILED DESCRIPTION OF THE EXEMPLARY EMBODIMENTS

First Embodiment

A detailed description of a first embodiment of an EGR cooler bypass valve embodied as an EGR cooler unit will now be given referring to the accompanying drawings.

(Configuration Outline of EGR Cooler Unit)

Figure 1:
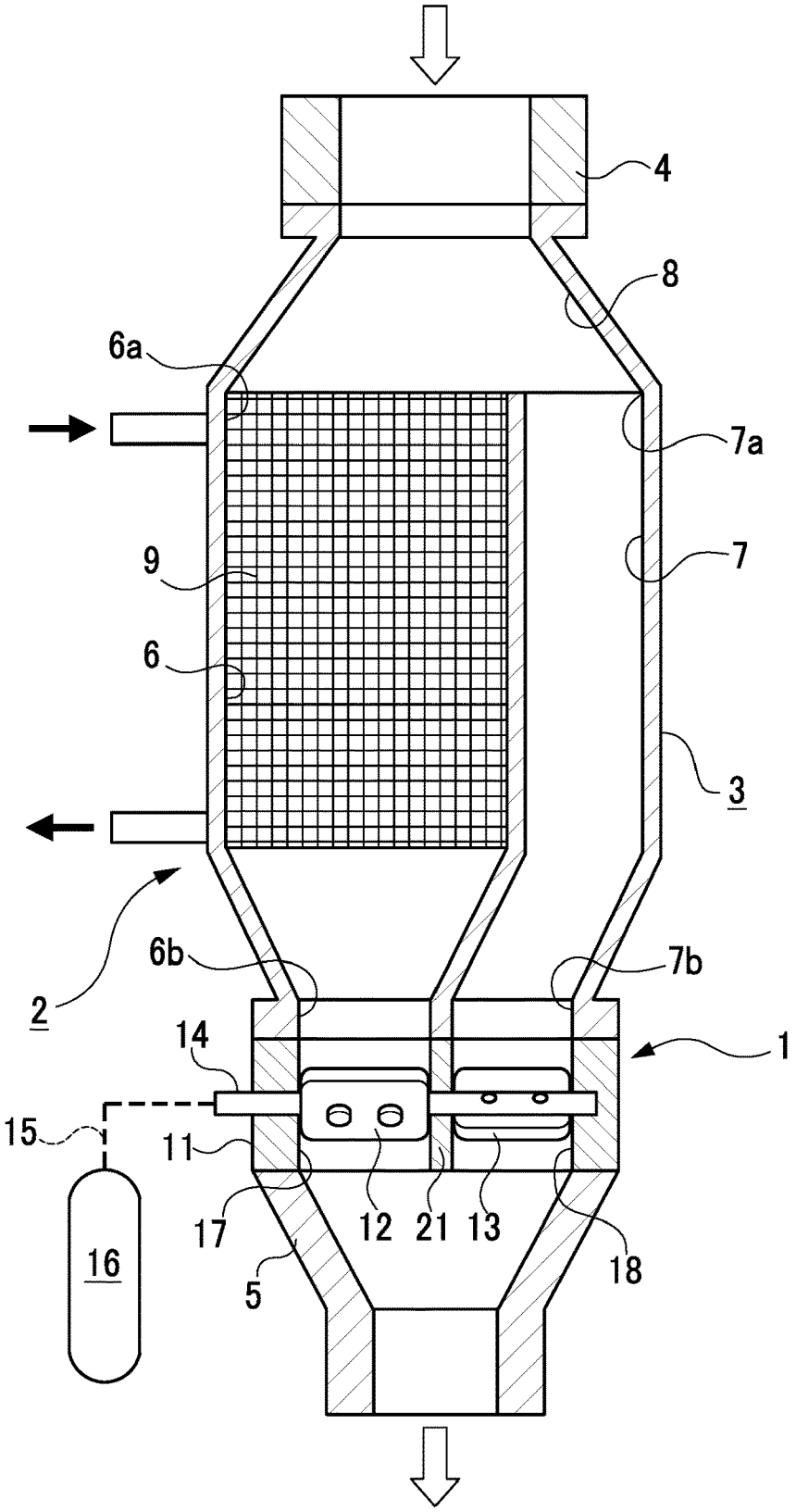
FIG. 1 is a cross-sectional view schematically showing an EGR cooler unit provided with an EGR cooler bypass valve (a bypass valve) in a first embodiment.

FIG. 1 is a cross-sectional view schematically showing an EGR cooler unit 2 of a parallel-flow type, provided with an EGR cooler bypass valve 1 (hereinafter, simply referred to as a "bypass valve") in the present embodiment. This EGR cooler unit 2 is placed at some place in an EGR passage (not shown) and is provided with a cooler casing 3, an inlet pipe 4 provided on an inlet side of the cooler casing 3, and the bypass valve 1 and an outlet pipe 5 both provided on an outlet side of the cooler casing 3. The cooler casing 3 includes a cooler passage 6, a bypass passage 7 bypassing the cooler passage 6, and a confluence part 8 in which an inlet 6*a* of the cooler passage 6 and an inlet 7*a* of the bypass passage 7 are confluent. The cooler passage 6 and the bypass passage 7 are placed in parallel to each other. The inlet pipe 4 is connected to the confluent part 8. The bypass valve 1 is connected to an outlet 6*b* of the cooler passage 6 and an outlet 7*b* of the bypass passage 7. The outlet pipe 5 is connected to an outlet side of the bypass valve 1. The cooler passage 6 is provided therein with a heat exchanger 9 through which engine cooling water flows. The cooler passage 6 and the heat exchange 9 constitute an EGR cooler. The inlet pipe 4 and the outlet pipe 5 are each connected to the EGR passage. The EGR gas having flowed in the inlet pipe 4 is cooled by the heat exchanger 9 by passing through the cooler passage 6. The EGR gas that passes through the bypass passage 7 is not cooled.

(About Bypass Valve)

Figure 2:
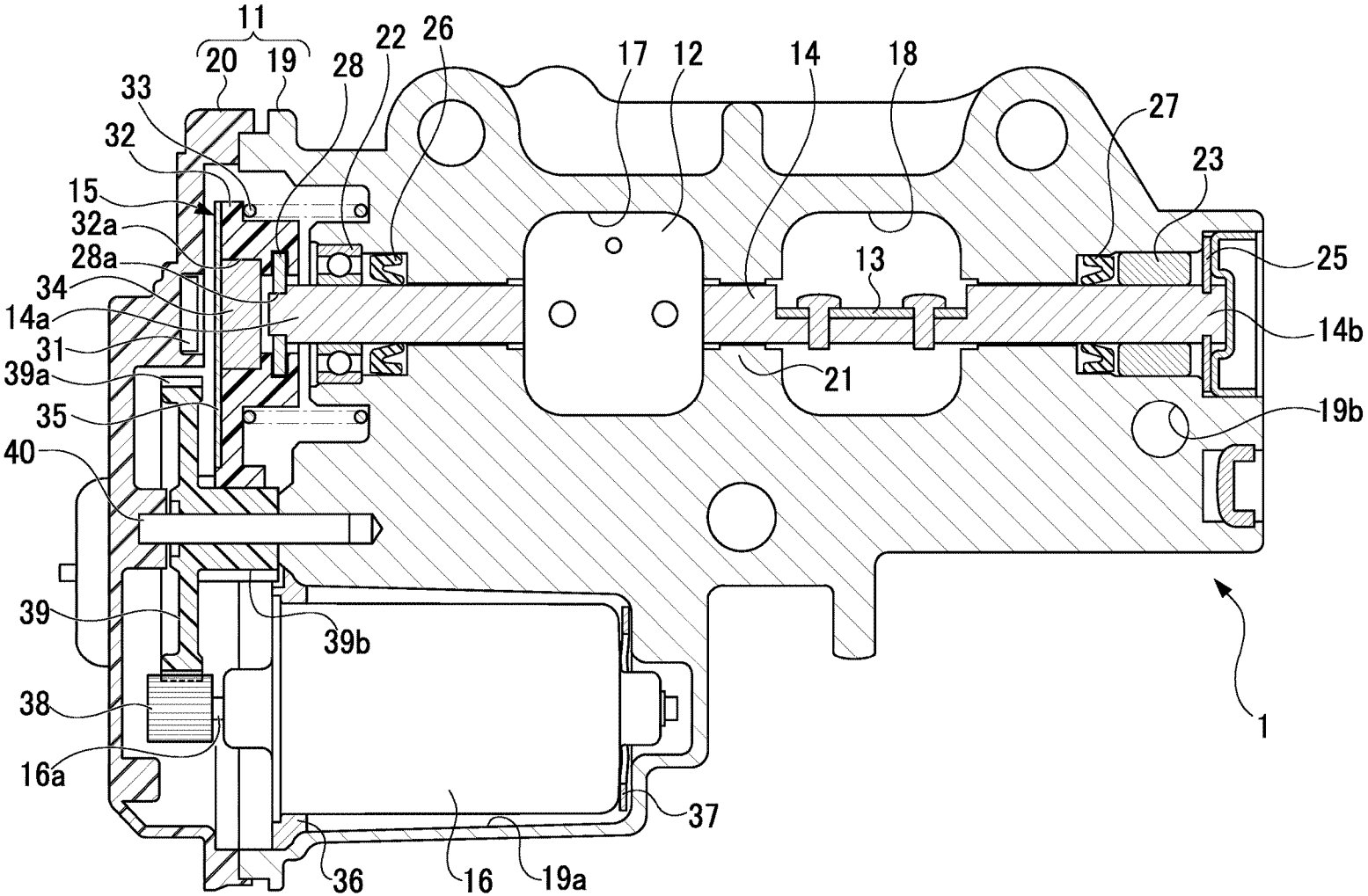
FIG. 2 is a cross-sectional view of the bypass valve in the first embodiment.

FIG. 2 is a cross-sectional view of the bypass valve 1 in the present embodiment. As shown in FIGS. 1 and 2, the bypass valve 1 is configured to simultaneously adjust a flow rate of EGR gas (a gas flow rate) passing through the EGR cooler (the cooler passage 6 and the heat exchanger 9) and a gas flow rate of EGR gas passing through the bypass passage 7. This bypass valve 1 is a series double-valve type and includes, as main components, a valve casing 11, two valve elements 12 and 13, a valve shaft 14, a speed reducing mechanism 15, and a DC motor 16. The valve casing 11 includes a main casing 19 made of aluminum including two flow passages 17 and 18, and an end frame 20 made of synthetic resin placed to close an open end of the main casing 19. The two valve elements 12 and 13, valve shaft 14, and DC motor 16 are placed in the main casing 19. The speed reducing mechanism 15 is placed between the main casing 19 and the end frame 20.

The main casing 19 includes a cooler flow passage 17 communicated with the outlet 6*b* of the cooler passage 6 and a bypass flow passage 18 communicated with the outlet 7*b* of the bypass passage 7. These cooler flow passage 17 and bypass flow passage 18 are separated by a partition wall 21. In the cooler flow passage 17, the EGR gas having passed through the cooler passage 6 flows. In the bypass flow passage 18, the EGR gas having passed through the bypass passage 7 flows. In the cooler flow passage 17, a cooler valve element 12 of a plate-like shape is placed to open and close the cooler flow passage 17. In the bypass flow passage 18, a bypass valve element 13 of a plate-like shape is placed to open and close the bypass flow passage 18. In the present embodiment, each of the cooler valve element 12 and the bypass valve element 13 is a butterfly valve and integrally fixed to a single valve shaft 14. The valve shaft 14 is placed in the main casing 19 by passing across the cooler flow passage 17, the partition wall 21, and the bypass flow passage 18 and is rotatably supported by two bearings 22 and 23. The cooler valve element 12 is fixed to the valve shaft 14 in the cooler flow passage 17 and the bypass valve element 13 is fixed to the valve shaft 14 in the bypass flow passage 18. Furthermore, the cooler valve element 12 and the bypass valve element 13 are fixed to the valve shaft 14 so that they are displaced in phase from each other by a predetermined angle. Accordingly, when the valve shaft 14 is rotated in one direction, the cooler valve element 12 turns in an opening direction and the bypass valve element 13 turns in a closing direction. In contrast, when the valve shaft 14 is rotated in an opposite direction, the cooler valve element 12 turns in a closing direction and the bypass valve element 13 turns in an opening direction. FIG. 2 shows the cooler valve element 12 in a fully closed state and the bypass valve element 13 in a fully opened state.

Figure 3:
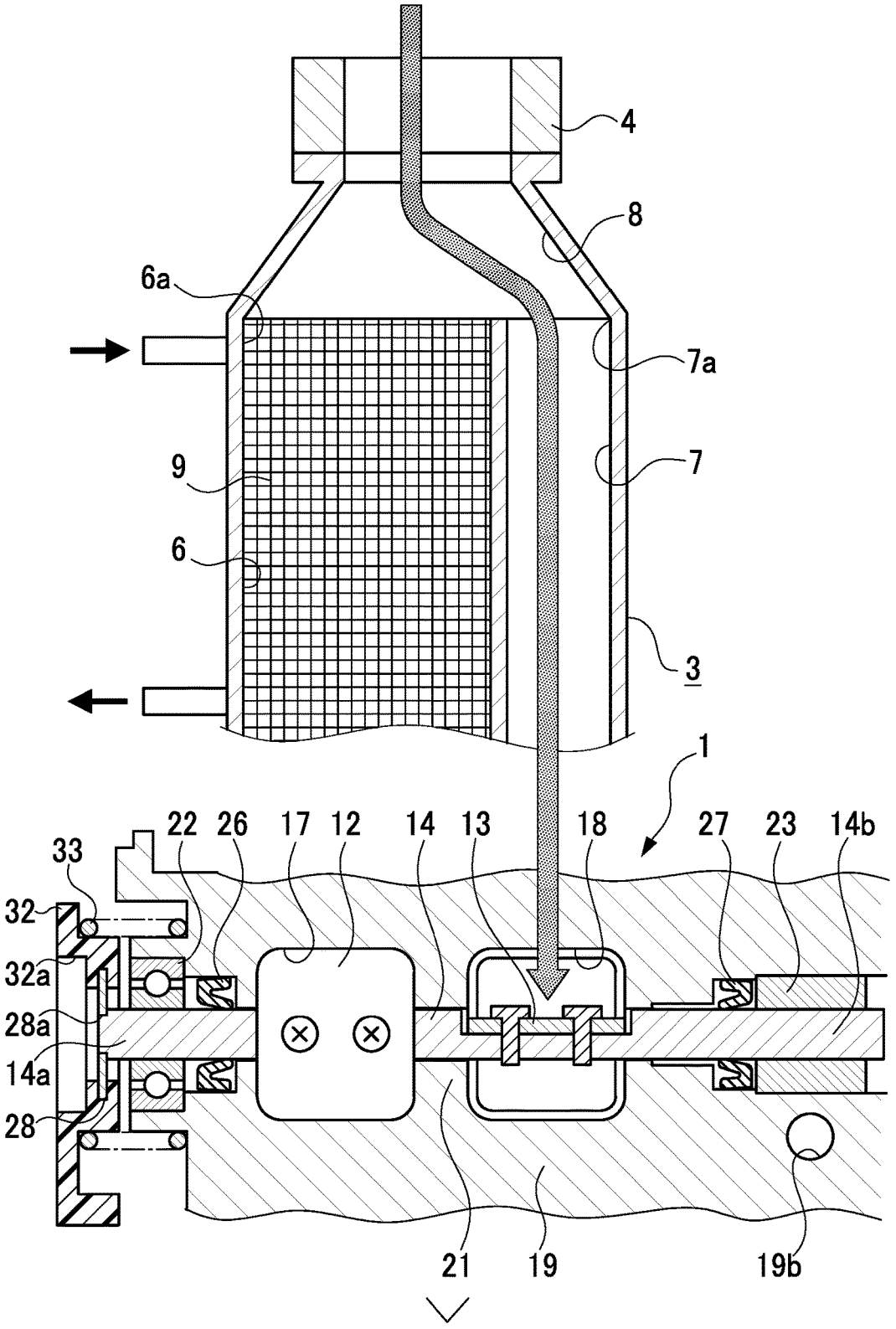
FIG. 3 is a partial cutaway view conceptually showing a relationship between a flow of EGR gas in a cooler casing and an open/closed state of each valve element of a bypass valve in the first embodiment.
Figure 4:
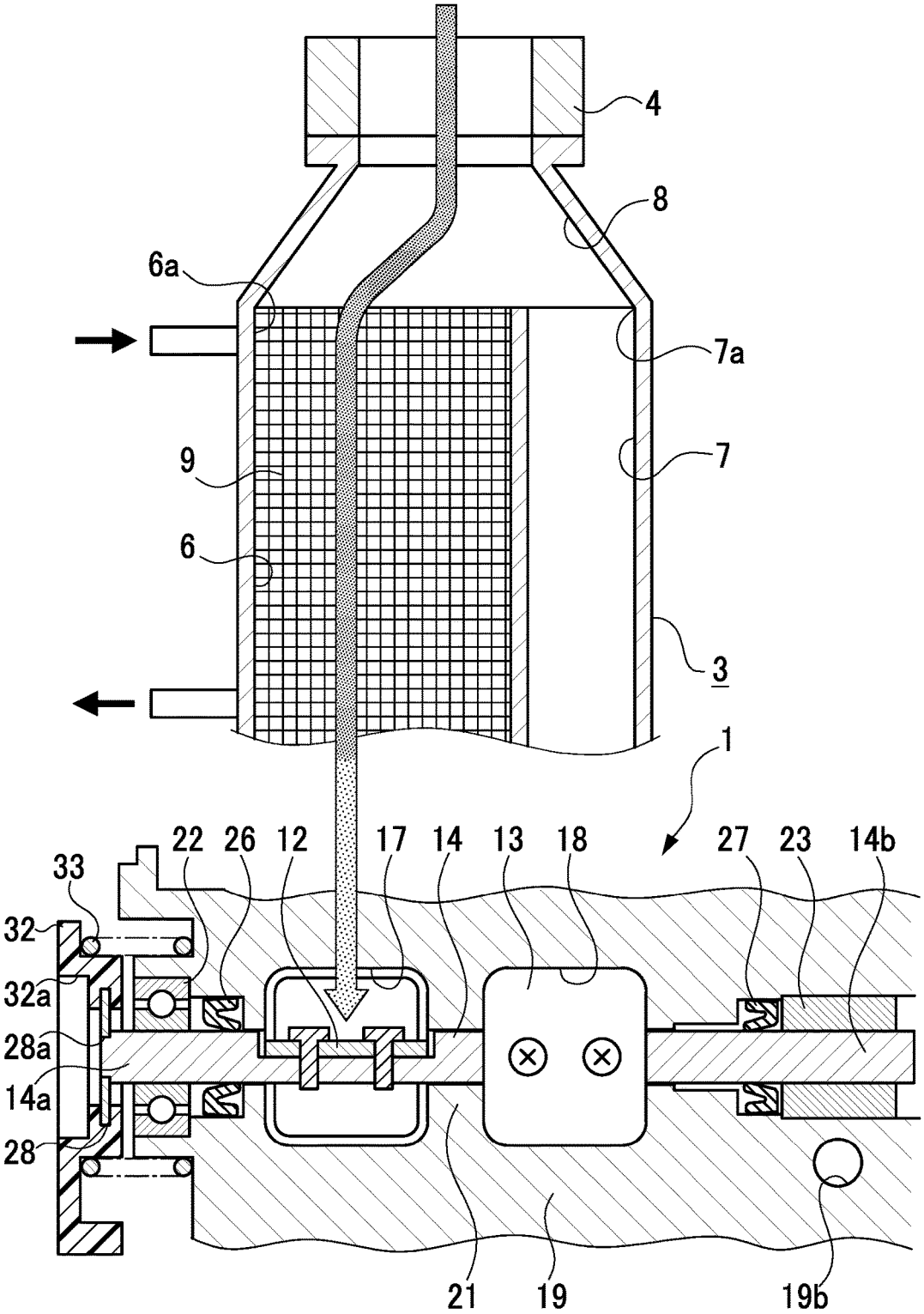
FIG. 4 is a partial cutaway view conceptually showing a relationship between a flow of EGR gas in the cooler casing and the an open/closed state of each valve element of the bypass valve in the first embodiment.

FIGS. 3 and 4 are each partial cutaway views conceptually showing a relationship between a flow of EGR gas in the cooler casing 3 and an open/closed state of each of the valve elements 12 and 13 in the bypass valve 1. In FIGS. 3 and 4, the cooler casing 3 and the bypass valve 1 are different from each other in orientation of cross-section and in magnification. In the bypass valve 1, furthermore, some members or components are not illustrated (the same applies to the following figures). FIG. 3 shows the cooler valve element 12 in a fully closed state and the bypass valve element 13 in a fully opened state. In this state, the EGR gas having flowed in the inlet pipe 4 passes through the bypass passage 7 without being cooled and directly flows in the bypass flow passage 18 of the bypass valve 1. On the other hand, FIG. 4 shows the cooler valve element 12 in a fully opened state and the bypass valve element 13 in a fully closed state. In this state, the EGR gas having flowed in the inlet pipe 4 is cooled by the heat exchanger 9 by passing through the cooler passage 6 and then flows in the cooler flow passage 17 of the bypass valve 1.

As shown in FIGS. 2 to 4, the valve shaft 14 is rotatably supported by the main casing 19 through the two bearings 22 and 23. The valve shaft 14 includes a first shaft end portion 14*a* and a second shaft end portion 14*b* at both ends. The two valve elements 12 and 13 are fixed on the valve shaft 14 between the first shaft end portion 14*a* and the second shaft end portion 14*b*. The cooler flow passage 17 and the cooler valve element 12 are placed adjacent to the first shaft end portion 14*a*, and the bypass flow passage 18 and the bypass valve element 13 are placed adjacent to the second shaft end portion 14*b*. Herein, the valve shaft 14 can be defined that the first shaft end portion 14*a* includes an entire range located outside of the cooler valve element 12 (a part of the valve shaft 14 on one end side) and the second shaft end portion 14*b* includes an entire range located outside of the bypass valve element 13 (a part of the valve shaft 14 on the other end side). The first bearing 22 is placed between the main casing 19 and the first shaft end portion 14*a*. On the other hand, the second bearing 23 is placed between the main casing 19 and the second shaft end portion 14*b*. Further, as shown in FIG. 2, the main casing 19 is provided with a retainer 25 in correspondence with a leading end of the second shaft end portion 14*b* to prevent positional displacement of the valve shaft 14 in an axial direction thereof. Between the retainer 25 and the second shaft end portion 14*b*, a spring (not shown) is provided to urge the valve shaft 14 in a rotating direction. Furthermore, between the cooler valve element 12 and the first bearing 22, a first seal member 26 for sealing between the first shaft end portion 14*a* and the main casing 19 is provided adjacent to a side surface of the first bearing 22 closer to the cooler valve element 12 relative to an opposite side surface of the first bearing 22. Between the bypass valve element 13 and the second bearing 23, a second seal member 27 for sealing between the second shaft end portion 14*b* and the main casing 19 is provided adjacent to a side surface of the second bearing 23 closer to the bypass valve element 13 relative to an opposite side surface of the second bearing 23. Each of the seal members 26 and 27 includes a resin or rubber element. For those seal members 26 and 27, for example, a PTFE seal may be adopted. The first seal member 26 is configured to prevent foreign matters and water/moisture from the cooler flow passage 17 from entering in between the first shaft end portion 14*a* and the main casing 19. The second seal member 27 is configured to prevent foreign matters and water/moisture from the bypass flow passage 18 from entering in between the second shaft end portion 14*b* and the main casing 19.

In FIG. 2, the end frame 20 is detachably fixed to the main casing 19 with a plurality of clips (not shown). Inside the end frame 20, an opening-degree sensor 31 is provided in correspondence with the leading end of the first shaft end portion 14*a* to detect the opening degree (the valve opening degree) of each valve element 12 and 13. The opening-degree sensor 31 consists of a hall IC and others and configured to detect a rotation angle of the valve shaft 14 as the valve opening degree. The leading end of the first shaft end portion 14*a* is fixed with a main gear 32 serving as a driven gear. The main gear 32 is made of resin and corresponds to a resin gear (a plastic gear) in the present disclosure. Herein, the main gear 32 includes, in its center, a metal lever 28 integrally provided by insert molding. The lever 28 corresponds to one example of a metal connecting member in the present disclosure. The lever 28 is formed, at its center, with a center hole 28*a*. The leading end of the first shaft end portion 14*a* is fitted and welded in this center hole 28*a*. Specifically, the leading end of the first shaft end portion 14*a* is coupled to the main gear 32 through the lever 28 so that the first shaft end portion 14 is rotatable together with the main gear 32. Further, a return spring 33 is placed between the main gear 32 and the main casing 19 to urge each valve element 12 and 13 in a closing direction or an opening direction. The main gear 32 is formed, on its front side (a left side in FIG. 2), with a recessed portion 32*a*. In this recessed portion 32*a*, a magnet 34 is accommodated. This magnet 34 is fixed by a pressing plate 35 formed of a leaf spring. Accordingly, as the main gear 32 is rotated integrally with each of the valve elements 12 and 13 and the valve shaft 14, the magnetic field of the magnet 34 changes, and the opening-degree sensor 31 detects such a change in magnetic field as the valve opening degree.

In the present embodiment, the DC motor 16 is accommodated in a cavity 19*a* formed in the main casing 19. Both ends of the DC motor 16 are fixed to the main casing 19 through a retaining member 36 and a leaf spring 37. The DC motor 16 is drivingly connected to the valve shaft 14 through the speed reducing mechanism 15 as shown in FIGS. 1 and 2 to drivingly open and close the valve elements 12 and 13. On an output shaft 16*a* of the DC motor 16, a motor gear 38 is fixed. This motor gear 38 is drivingly coupled to the main gear 32 through an intermediate gear 39. The intermediate gear 39 is a two-stage gear including a large-diameter gear 39*a* and a small-diameter gear 39*b*. This intermediate gear 39 is rotatably supported by the main casing 19 through a pin shaft 40. The large-diameter gear 39*a* is connected to the motor gear 38. The small-diameter gear 39*b* is connected to the main gear 32. In the present embodiment, the main gear 32 and the intermediate gear 39 constituting the speed reducing mechanism 15 are each made of resin for weight saving.

As described above, the bypass valve 1 is configured to rotate the valve shaft 14 to thereby open and close the valve elements 12 and 13 to control a flow rate of EGR gas in each of the flow passages 17 and 18. Accordingly, for example, as shown in FIG. 3, when the DC motor 16 is activated by energization from the fully closed state of the cooler valve element 12 and the fully opened state of the bypass valve element 13, the motor gear 38 is rotated in one direction and this rotation of the motor gear 38 is decelerated by the intermediate gear 39 and transmitted to the main gear 32. Thus, the valve shaft 14 and the valve elements 12 and 13 are rotated against the urging force of the return spring 33, thereby opening the cooler flow passage 17 and closing the bypass flow passage 18. When the DC motor 16 is energized to generate a torque in order to hold each of the valve elements 12 and 13 at respective opening degrees, the torque is transmitted as a holding force to the valve shaft 14 and each valve element 12 and 13 through the motor gear 38, the intermediate gear 39, and the main gear 32. This holding force is balanced with the urging force of the return spring 33 and thus the the valve elements 12 and 13 are held at respective intermediate opening degrees. Further, as shown in FIG. 3, when the cooler valve element 12 is placed in the fully closed position, the bypass valve element 13 is placed in the fully opened position, so that the EGR gas not cooled by bypassing the EGR cooler is allowed to flow through the bypass passage 7 and the bypass flow passage 18. Still further, as shown in FIG. 4, when the cooler valve element 12 is placed in the fully opened position, the bypass valve element 13 is placed in the fully closed position, so that the EGR gas cooled by the EGR cooler is allowed to flow through the cooler passage 6 and the cooler flow passage 17. In the present embodiment, the valve elements 12 and 13 are each placed to be switched between the fully closed position and the fully open position and also can be placed at any intermediate opening degree between the fully closed position and the fully opened position. The opening degrees of both the valve elements 12 and 13 are controlled in the aforementioned manner to respectively adjust a flow amount of gas allowed to pass through the cooler flow passage 17 and a flow amount of gas allowed to pass through the bypass flow passage 18, thereby enabling the temperature of EGR gas (gas outlet temperature) flowing out of the outlet pipe 5 to an arbitrary temperature.

(About Technical Features of Bypass Valve)

Herein, the first shaft end portion 14*a* of the valve shaft 14 is drivingly connected to the DC motor 16 through the speed reducing mechanism 15 including the main gear 32 and others. Further, the main gear 32 is fixed with the magnet 34 in correspondence with the opening-degree sensor 31 to detect the valve opening degree. For this purpose, the rotation of the first shaft end portion 14*a* needs to be supported precisely (rigidly). Since each of the seal members 26 and 27 includes a resin or rubber element, these seal members 26 and 27 have to be protected from heat damage by EGR gas flowing through the flow passages 17 and 18. In particular, since the high-temperature (in the neighborhood of 720° C.) EGR gas not cooled by the EGR cooler flows in the bypass flow passage 18, heat damage to the second seal member 27 especially becomes problematic. Similarly, the main gear 32 made of resin has to be protected from heat damage by EGR gas. Therefore, the bypass valve 1 in the present embodiment is provided with the following technical features to address the aforementioned purpose.

In the present embodiment, the cooler flow passage 17 and the cooler valve element 12 are placed adjacent to the first shaft end portion 14*a* and the bypass flow passage 18 and the bypass valve element 13 are placed adjacent to the second shaft end portion 14*b*. Further, the first bearing 22 consists of a rolling bearing (a ball bearing) that can achieve high accuracy and enhance heat resistance in order to precisely support the rotation of the first shaft end portion 14*a*. Herein, the rolling bearing can release the heat transmitted to the first shaft end portion 14*a* to the main casing 19, but it is smaller in heat-transfer property than a slide bearing. On the other hand, the second bearing 23 consists of a slide bearing in order to prompt heat radiation from the second shaft end portion 14*b* to the main casing 19. Since the second shaft end portion 14*b* receives the heat of high-temperature EGR gas flowing through the bypass flow passage 18, the slide bearing is adopted to smoothly release that heat to the main casing 19. In addition, the main casing 19 near the second bearing 23 is formed with a cooling-water passage 19*b* through which cooling water flows. The cooling water flowing through this cooling-water passage 19*b* cools the second bearing 23 and the second shaft end portion 14*b*.

According to the bypass valve 1 in the present embodiment explained as above, the first shaft end portion 14*a* and the second shaft end portion 14*b* of the valve shaft 14 are rotatably supported in the main casing 19 respectively through the first bearing 22 and the second bearing 23. Furthermore, for rotating the valve shaft 14, the leading end of the first shaft end portion 14*a* is drivingly connected to the DC motor 16 through the speed reducing mechanism 15 including the main gear 32. When the valve shaft 14 is rotated by the speed-reducing mechanism 15 and others to open and close the valve elements 12 and 13, the EGR gas flow amount in each of the flow passages 17 and 18 is regulated, thereby adjusting the temperature of the EGR gas flowing out of the EGR cooler unit 2.

According to the structure in the present embodiment, in the main casing 19 of the bypass valve 1, the EGR gas having flowed through the EGR cooler (the cooler passage 6 and the heat exchanger 9) and thus having been cooled therein passes through the cooler flow passage 17, and the EGR gas having flowed through the bypass passage 7 and thus having not been cooled therein passes through the bypass flow passage 18. Further, the cooler flow passage 17 and the cooler valve element 12 are placed adjacent to the first shaft end portion 14*a*, and the bypass flow passage 18 and the bypass valve element 13 are placed adjacent to the second shaft end portion 14*b*. Accordingly, the amount of heat transferred from the EGR gas flowing through the cooler flow passage 17 to the first shaft end portion 14*a* is smaller than the amount of heat transferred from the EGR gas flowing through the bypass flow passage 18 to the second shaft end portion 14*b*. Thus, the temperature of the first shaft end portion 14*a* is relatively low, so that the first seal member 26 is prevented from becoming overheated. Further, the heat amount of EGR gas transferred from the cooler valve element 12 to the first shaft end portion 14*a* is smaller than the heat amount transferred from the bypass valve element 13 to the second shaft end portion 14*b*. Thus, the temperature of the first shaft end portion 14*a* is relatively low, so that the first seal member 26 is prevented from becoming overheated. This can prevent the first seal member 26 from thermal degradation due to the heat damage by EGR gas and enhance the heat resistance of the first seal member 26. In other words, the first seal member 26 can be protected from the heat damage by EGR gas. Furthermore, the main gear 32, constituting the speed reducing mechanism 15, is fixed to the leading end of the first shaft end portion 14*a*, and the first bearing 22 supporting the first shaft end portion 14*a* consists of the rolling bearing. Thus, the rotation of the first shaft end portion 14*a* rotated together with the main gear 32 is precisely supported by the first bearing 22. Accordingly, the valve shaft 14 can be drivingly connected to the speed reducing mechanism 15 with precision and stability. Further, the meshing between the main gear 32 and the intermediate gear 39 can be made smooth to suppress wearing away of both the gears 32 and 39. The valve shaft 14 can be precisely and stably rotated and hence a change in the magnetic field of the magnet 34 rotated integrally with the main gear 32 can be accurately detected by the opening-degree sensor 31. Thus, high detection accuracy can be achieved. Furthermore, the second bearing 23 supporting the second shaft end portion 14*b* consists of a slide bearing having good heat radiation property. This allows a large amount of heat to be released from the second shaft end portion 14*b* to the main casing 19, so that the temperature of the second shaft end portion 14*b* is lower, thereby suppressing overheating of the second seal member 27. Accordingly, the second seal member 27 can be prevented from thermal degradation due to heat damage by EGR gas and can exhibit further enhanced heat resistance property. In other words, the second seal member 27 can be protected from heat damage by EGR gas.

In the present embodiment, the cooling-water passage 19*b* is provided near the second bearing 23. Thus, the heat to be released from the second bearing 23 to the main casing 19 is released into the cooling water in the cooling-water passage 19*b*. In this regard, the second shaft end portion 14*b* can be effectively cooled and the thermal degradation of the second seal member 27 can be effectively reduced.

Second Embodiment

Next, a second embodiment of an EGR cooler bypass valve embodied as an EGR cooler unit will be described below with reference to the accompanying drawings.

It is noted that similar or identical parts or components to those in the first embodiment are given the same reference signs and their explanation is omitted. The following embodiments are made with a focus on differences from the first embodiment.

Figure 5:
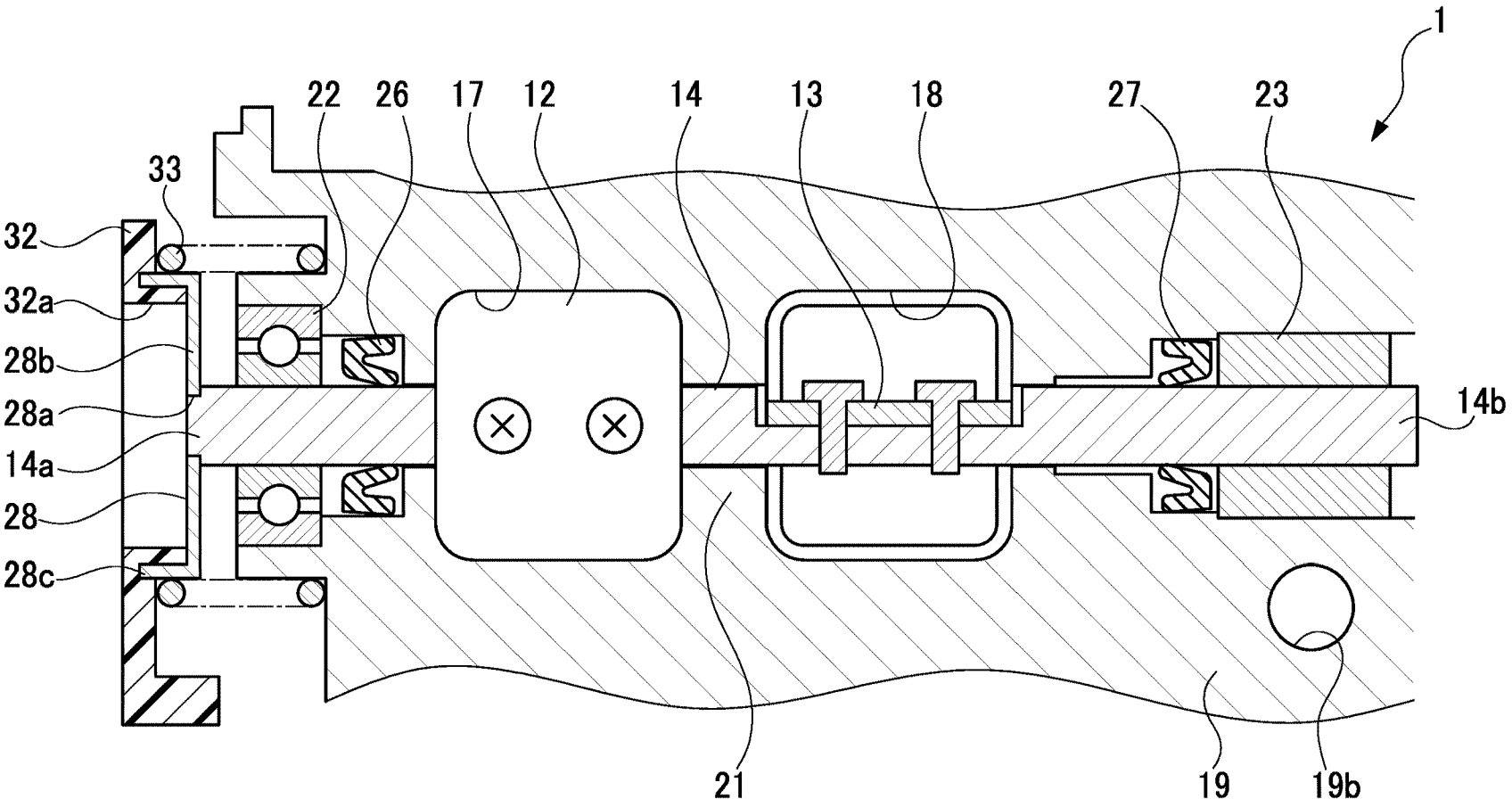
FIG. 5 is a partial cutaway view schematically showing main parts of a bypass valve in a second embodiment.

This second embodiment differs from the first embodiment in the shape of the lever 28 provided in the main gear 32. FIG. 5 is a partial cutaway view schematically showing main parts of the bypass valve 1. As shown in FIG. 5, the lever 28 of this embodiment includes a bottom wall 28*b* having a nearly circular disc shape (having a center hole 28*a*) and a peripheral wall 28*c* protruding from the outer periphery of the bottom wall 28*b* to extend in an opposite direction to the first bearing 22. The lever 28 is designed such that the bottom wall 28*b* has a larger diameter than that of the lever 28 of the first embodiment and also the lever 28 of the present embodiment is integrally provided with the main gear 32 such that the bottom wall 28*b* is exposed from a bottom side of the main gear 32. Further, a part of the peripheral wall 28*c* is also exposed from the main gear 32 so that a part of the return spring 33 contacts the outer periphery of the exposed part of the peripheral wall 28*c*. The configuration of the lever 28 in the present embodiment corresponds to one example of a heat-transfer reducing structure for reducing heat transfer from the first shaft end portion 14*a* to the main gear 32 which is a resin gear in the present disclosure.

The structure in the present embodiment provides the following operations and advantages in addition to the operations and advantages in the first embodiment. Specifically, in the present embodiment, the lever 28 is larger in diameter than that in the first embodiment and also a part of the lever 28 is exposed from the bottom of the main gear 32, and the return spring 33 contacts the exposed part of the lever 28. Accordingly, the heat-transfer pathway from the first shaft end portion 14*a* to and throughout the lever 28 is relatively long. The heat transferred from the first shaft end portion 14*a* to the lever 28 is caused to release to the main casing 19 and the outside through the return spring 33. This reduces the amount of heat to be transferred from the first shaft end portion 14*a* to the main gear 32, leading to suppression of overheating of the main gear 32. Accordingly, the main gear 32 can be prevented from thermal degradation due to heat damage by EGR gas and can exhibit further enhanced heat resistance property.

Third Embodiment

Next, a third embodiment of an EGR cooler bypass valve embodied as an EGR cooler unit will be described below with reference to the accompanying drawings.

Figure 6:
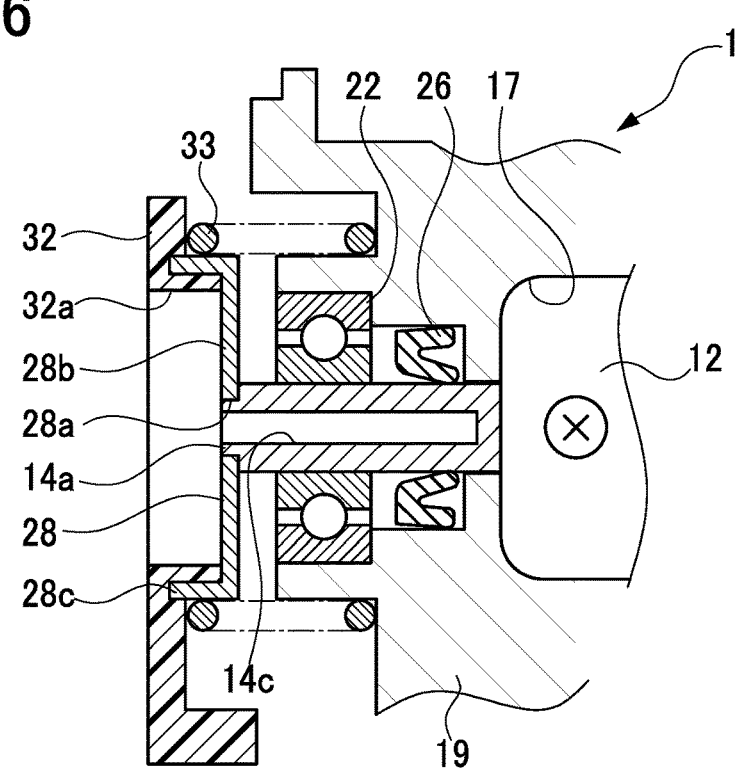
FIG. 6 is a partial cutaway view schematically showing main parts of a bypass valve in a third embodiment.

This third embodiment differs from the second embodiment in the shape of the first shaft end portion 14*a*. FIG. 6 is a partial cutaway view schematically showing main parts of the bypass valve 1. As shown in FIG. 6, in the present embodiment, the first shaft end portion 14*a* is formed with a shaft hole 14*c* extending inward from the leading end of the first shaft end portion 14*a* in an axial direction thereof. Other configurations are identical to those in the second embodiment. The shaft hole 14*c* corresponds to one example of the heat-transfer reducing structure in the present disclosure.

The structure in the present embodiment provides the following operations and advantages in addition to the operations and advantages in the second embodiment. In the present embodiment, specifically, the first shaft end portion 14*a* includes a part formed with the shaft hole 14*c* so that this part has a reduced cross-sectional area for the heat-transfer pathway. Accordingly, the amount of heat to be transferred from the first shaft end portion 14*a* to the main gear 32 is further reduced, leading to further suppression of overheating of the main gear 32. Accordingly, the main gear 32 can be further prevented from thermal degradation and can exhibit further enhanced heat resistance property.

Fourth Embodiment

Next, a fourth embodiment of an EGR cooler bypass valve embodied as an EGR cooler unit will be described below with reference to the accompanying drawings.

Figure 7:
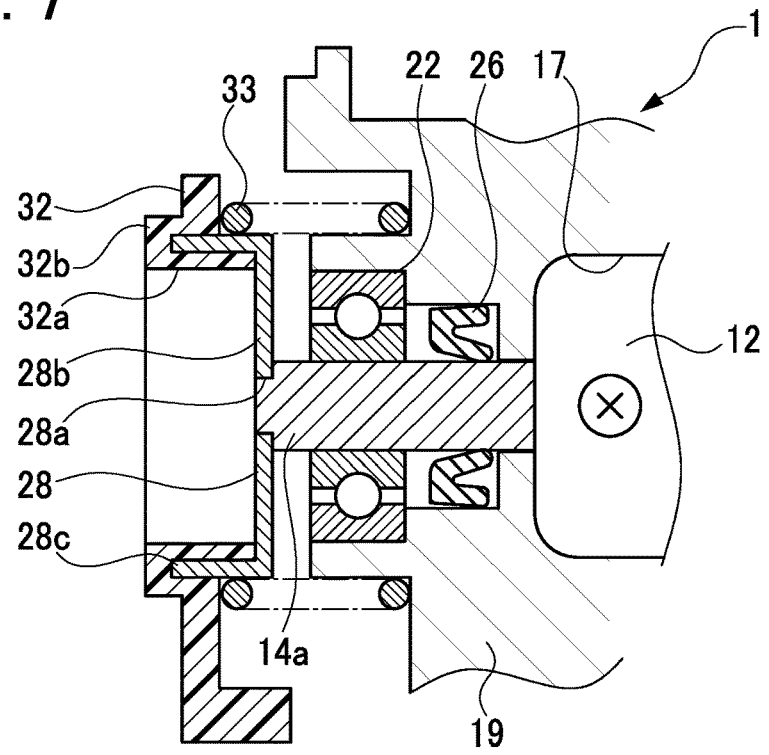
FIG. 7 is a partial cutaway view schematically showing main parts of a bypass valve in a fourth embodiment.

This fourth embodiment differs from the second embodiment in the shape of the main gear 32 and the shape of the lever 28. FIG. 7 is a partial cutaway view schematically showing main parts of the bypass valve 1. As shown in FIG. 7, the height (the length in an axial direction) of the peripheral wall 28*c* of the lever 28 in the present embodiment is about twice the height of the peripheral wall 28*c* of the lever 28 in the second embodiment. Further, in association with this extended peripheral wall 28*c* relative to that in the second embodiment, the main gear 32 is formed, on its end face on the front side (a left side in FIG. 7), with a protruded portion 32*b* protruding outward in the axial direction. Other configurations are identical to those in the second embodiment. The protruded portion 32*b* and the peripheral wall 28*c* correspond to one example of the heat-transfer reducing structure in the present disclosure.

The structure in the present embodiment provides the following operations and advantages in addition to the operations and advantages in the second embodiment. Specifically, in the present embodiment, the lever 28 includes the extended peripheral wall 28*c* and correspondingly the the main gear 32 includes the protruded portion 32*b*. Thus, the fastening surface area of the main gear 32 with the lever 28 is increased as compared with that in the second embodiment. Therefore, the amount of heat per unit area to be transferred from the first shaft end portion 14*a* to the main gear 32 is reduced, leading to further suppression of overheating of the main gear 32. Accordingly, the main gear 32 consisting of a resin gear can be further prevented from thermal degradation and can exhibit further enhanced heat resistance property.

Fifth Embodiment

Next, a fifth embodiment of an EGR cooler bypass valve embodied as an EGR cooler unit will be described below with reference to the accompanying drawings.

Figure 8:
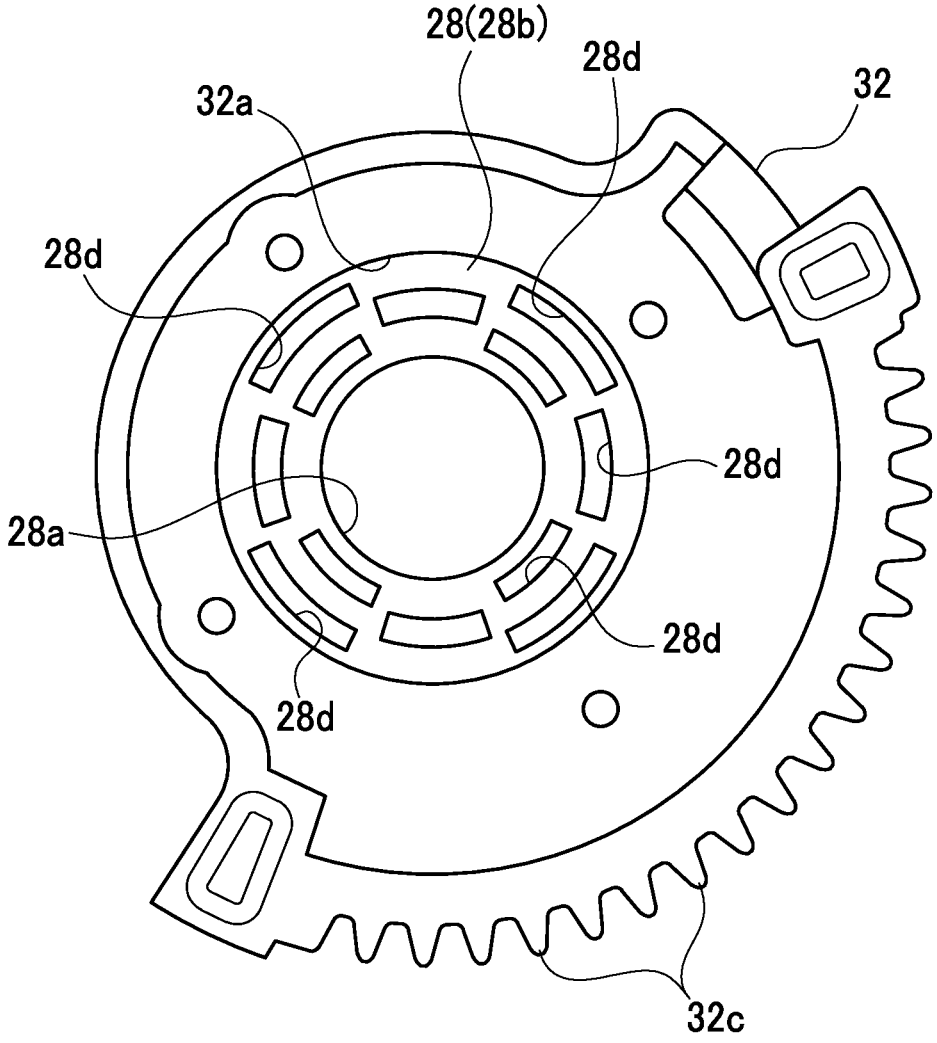
FIG. 8 is a plan view of a main gear in a fifth embodiment.

This fifth embodiment differs from the second embodiment in the shape of the lever 28. FIG. 8 is a plan view of the main gear 32. As shown in FIG. 8, the main gear 32 has, on a part of the periphery, teeth 32*c* which mesh with the intermediate gear 39. In the recessed portion 32*a* of the main gear 32, the bottom wall 28*b* of the lever 28 is exposed. This bottom wall 28*b* includes a center hole 28*a* formed at the center and a plurality of arcuate holes 28*d* arranged around the center hole 28*a* and on multiple circumferences centered at the center hole 28*a*. The arcuate holes 28*d* are displaced from each other in a circumferential direction and a radial direction. Other structures are identical to those in the second embodiment. The arcuate holes 28*d* of the lever 28 correspond to one example of the heat-transfer reducing structure in the present disclosure.

The structure in the present embodiment provides the following operations and advantages in addition to the operations and advantages in the second embodiment. Specifically, in the present embodiment, the bottom wall 28*b* of the lever 28 is formed with the plurality of arcuate holes 28*d*, so that the surface area of the bottom wall 28*b* is increased by just that much, thereby allowing a larger amount of heat to release from the bottom wall 28*b* to the outside than in the second embodiment. In the bottom wall 28*b* of the lever 28, the heat-transfer pathways running from the center hole 28*a* toward the outer periphery are divided into a labyrinth manner by the plurality of arcuate holes 28*d*, so that the cross-sectional areas of the heat-transfer pathways are reduced by the arcuate holes 28*d*. This can reduce the amount of heat to be transferred from the first shaft end portion 14*a* to the main gear 32, leading to further suppression of overheating of the main gear 32. Accordingly, the main gear 32 consisting of a resin gear can be further prevented from thermal degradation and can exhibit further enhanced heat resistance property.

Sixth Embodiment

Next, a sixth embodiment of an EGR cooler bypass valve embodied as an EGR cooler unit will be described below with reference to the accompanying drawings.

Figure 9:
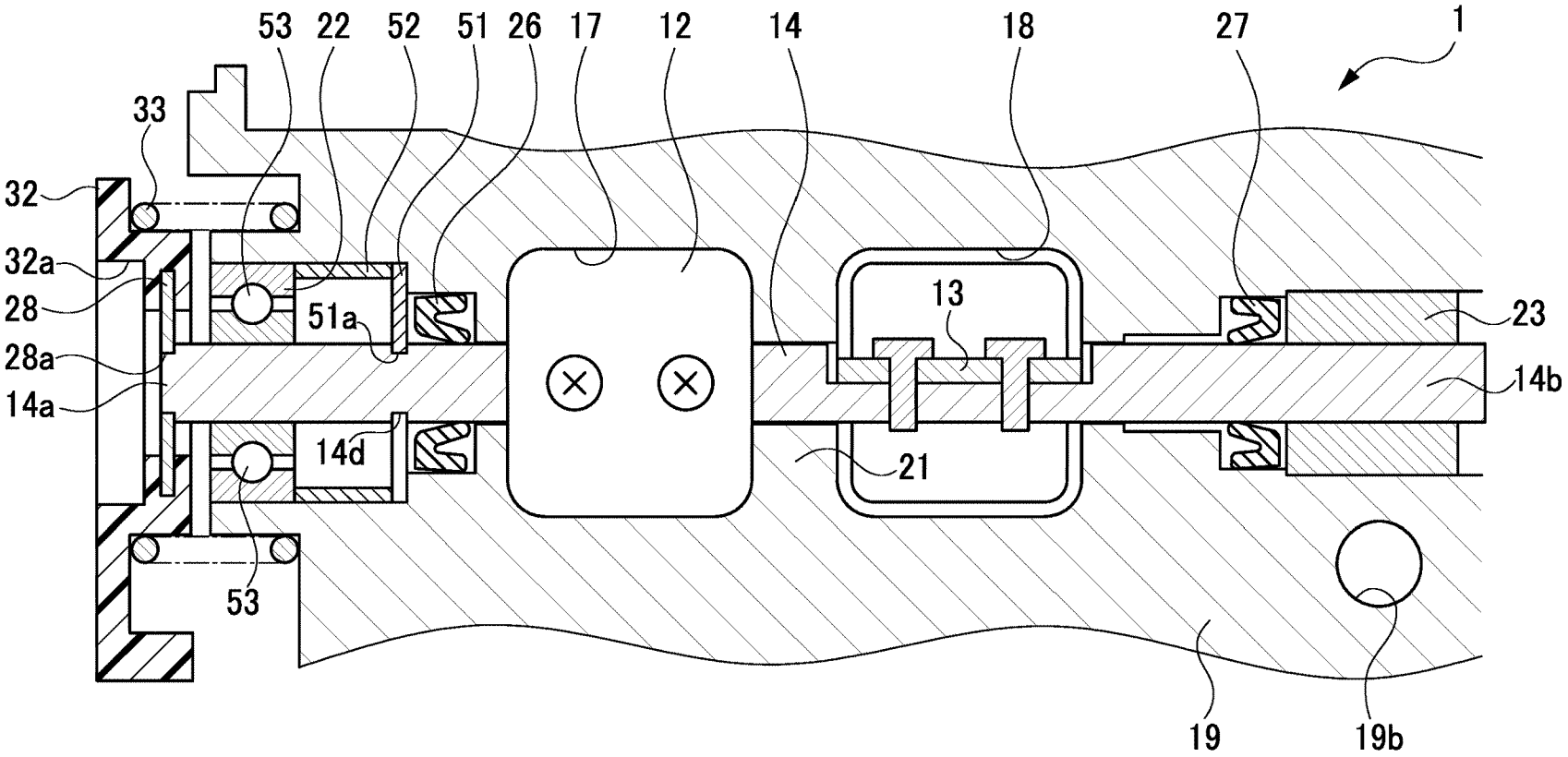
FIG. 9 is a partial cutaway view schematically showing main parts of a bypass valve in a sixth embodiment.
Figure 10:
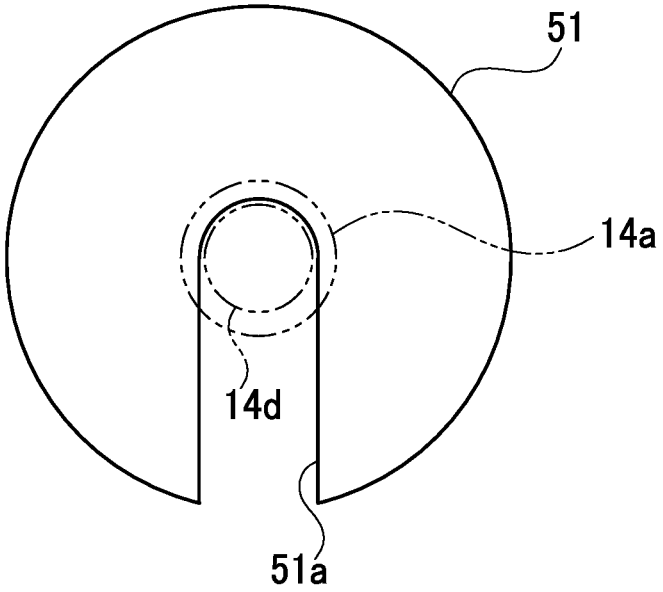
FIG. 10 is a plan view of a plate in the sixth embodiment.

This sixth embodiment differs from the first embodiment in that a heat-radiation promoting unit is provided between the first bearing 22 and the first seal member 26 to promote heat radiation from the first shaft end portion 14*a* to the main casing 19. FIG. 9 is a partial cutaway view schematically showing main parts of the bypass valve 1. FIG. 10 is a plan view of a plate 51 which will be described later. As shown in FIG. 9, in the main casing 19, the first bearing 22 and the first seal member 26 are placed at a predetermined distance from each other. In a position adjacent to the first seal member 26, the plate 51 having a nearly circular shape is provided on the first shaft end portion 14*a*. As shown in FIG. 10, the plate 51 is partly formed with a cutout 51*a* extending in a radial direction. The first shaft end portion 14*a* includes a groove 14*d* formed along the outer circumference of the first shaft end portion 14*a*. The plate 51 is positioned in contact with the outer periphery of the first shaft end portion 14*a* in such a way that the cutout 51*a* is fitted in the groove 14*d*. Furthermore, a tubular spacer 52 is placed between the plate 51 and the first bearing 22. This spacer 52 is placed such that one end of the spacer 52 in an axial direction contacts a part of the first bearing 22 and the other end of the spacer 52 in the axial direction contacts the plate 51, and the outer periphery of the spacer 52 contacts the main casing 19. Specifically, the first shaft end portion 14*a* and the first bearing 22 are in contact with the main casing 19 through the plate 51 and the spacer 52. The plate 51 and the spacer 52 constitute one example of the heat-radiation promoting unit in the present disclosure.

The structure in the present embodiment provides the following operations and advantages in addition to the operations and advantages in the first embodiment. In the present embodiment, specifically, the heat transferred from the EGR gas to the first shaft end portion 14*a* is then transferred from the first bearing 22 to the main casing 19.

At that time, because the first bearing 22 consists of a rolling bearing, the amount of heat to be transferred to the main casing 19 is relatively reduced. In the above configuration, the plate 51 and the spacer 52 each in contact with the main casing 19 are provided on the first shaft end portion 14*a* between the first bearing 22 and the first seal member 26. Thus, the heat radiation from the first shaft end portion 14*a* to the main casing 19 is promoted, so that the amount of heat to be transferred from the first shaft end portion 14*a* to the main gear 32 and to the first seal member 26 is reduced by just that much. Accordingly, the the main gear 32 consisting of a resin gear and the first seal member 26 can be further prevented from thermal degradation due to heat damage by EGR gas and the main gear 32 and the first seal member 26 can exhibit enhanced heat resistance property.

Seventh Embodiment

Next, a seventh embodiment of an EGR cooler bypass valve embodied as an EGR cooler unit will be described below with reference to the accompanying drawings.

Figure 11:
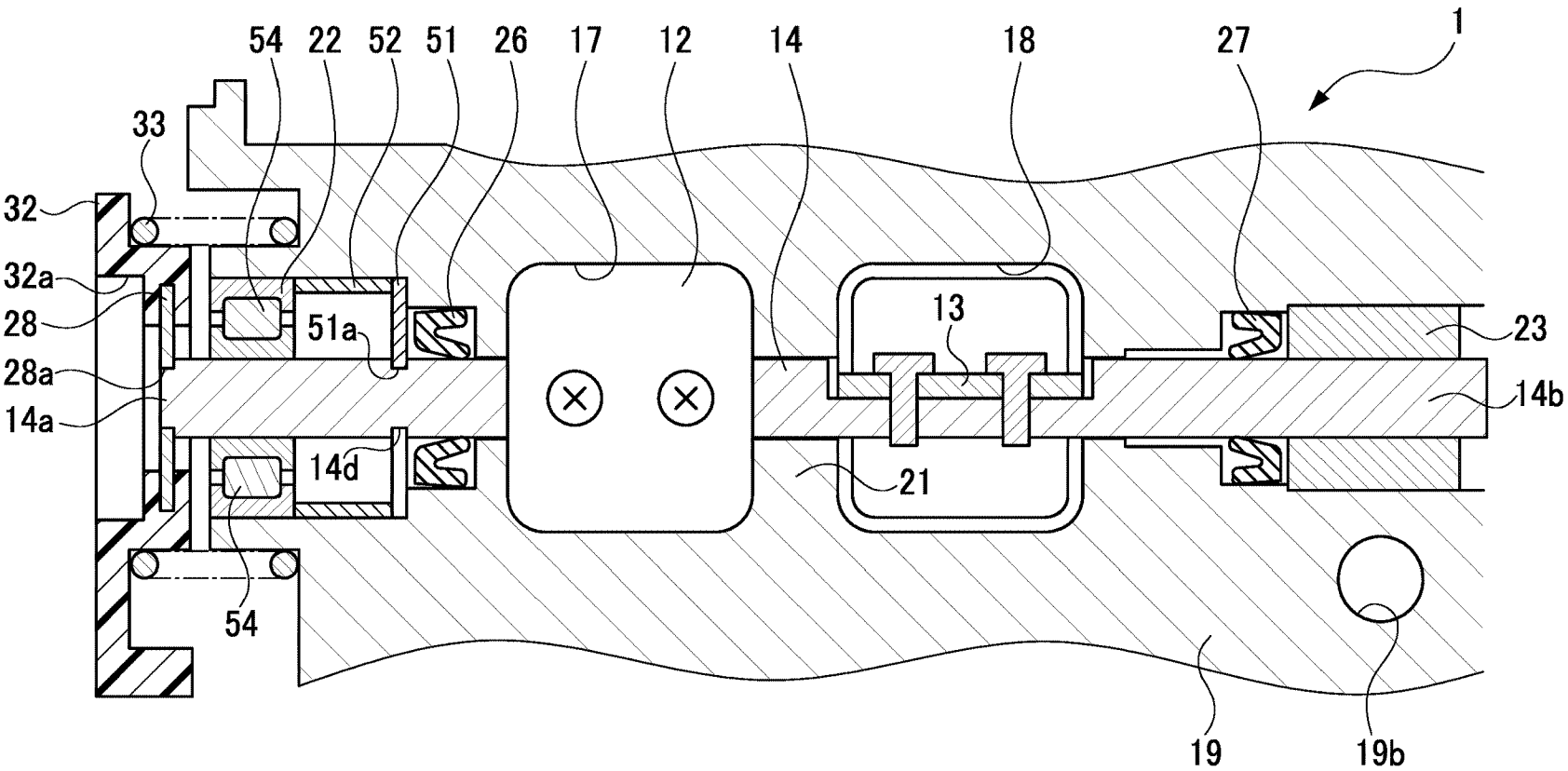
FIG. 11 is a partial cutaway view schematically showing main parts of a bypass valve in a seventh embodiment.

FIG. 11 is a partial cutaway view schematically showing main parts of the bypass valve 1. As shown in FIG. 11, this seventh embodiment differs from the sixth embodiment in that the rolling bearing constituting the first bearing 22 includes a plurality of needles 54 instead of a plurality of balls 53. Each of the needles 54 has a nearly cylindrical shape. As is seen from a difference between the first bearing 22 in FIG. 11 and the first bearing 22 in FIG. 9, the surface area of each needle 54 of the first bearing 22 in FIG. 11 contacting other bearing components is larger than the surface area of each ball 53 of the first bearing 22 in FIG. 9 contacting other bearing components.

The structure in the present embodiment provides the following operations and advantages in addition to the operations and advantages in the sixth embodiment. In the present embodiment, specifically, the first bearing 22 is formed of a needle bearing, so that a larger amount of heat is released from the first shaft end portion 14*a* to the main casing 19 through the first bearing 22 than in the sixth embodiment. Thus, the heat radiation from the first shaft end portion 14*a* to the main casing 19 is promoted. This promotion of heat radiation further enables reduction in the amount of heat to be transferred from the first shaft end portion 14*a* to the main gear 32 and the first seal member 26. Accordingly, the the main gear 32 consisting of a resin gear and the first seal member 26 can be further prevented from thermal degradation due to heat damage by EGR gas and can exhibit enhanced heat resistance property.

Eighth Embodiment

Next, an eighth embodiment of an EGR cooler bypass valve embodied as an EGR cooler unit will be described below with reference to the accompanying drawings.

Figure 12:
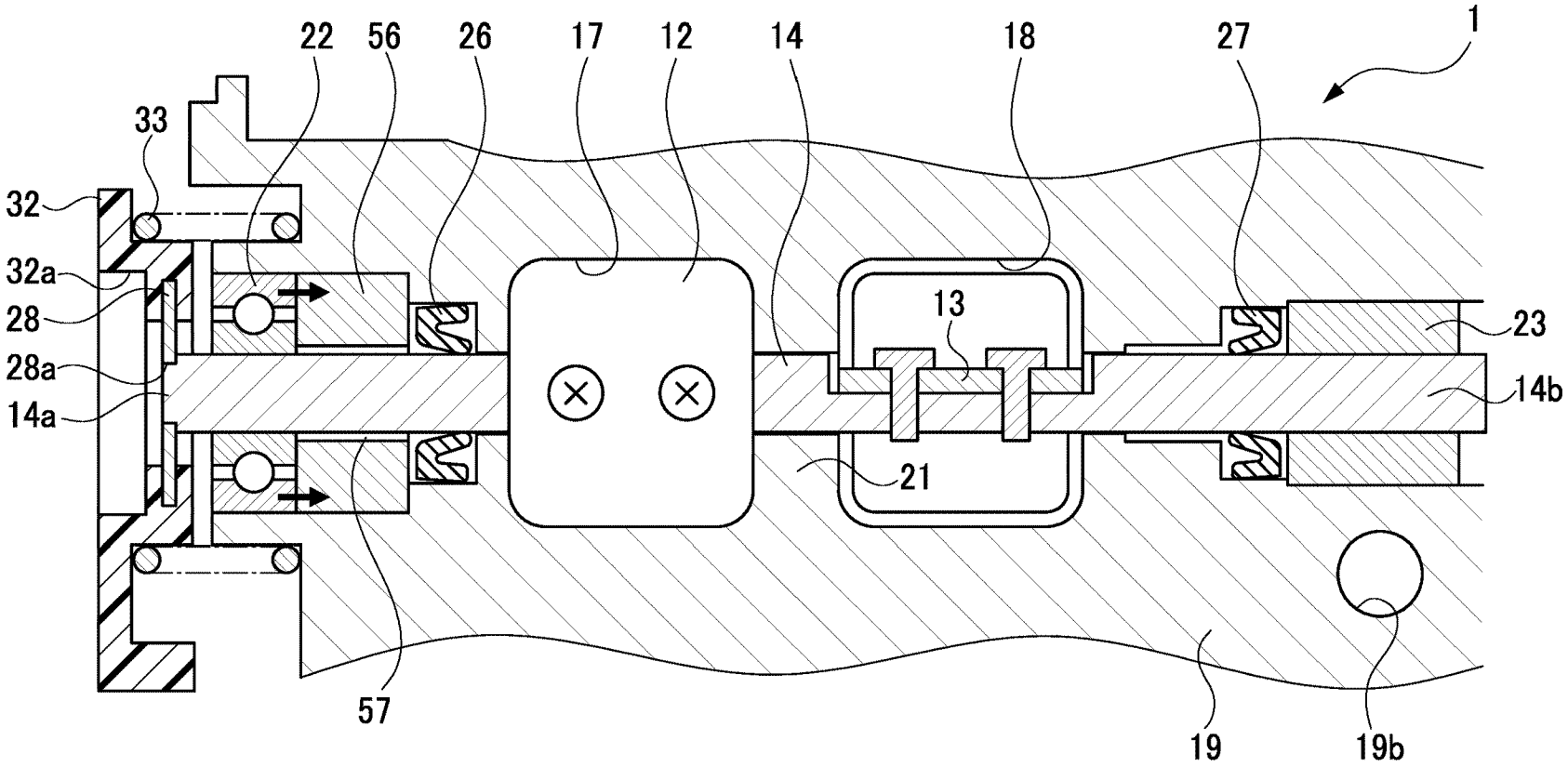
FIG. 12 is a partial cutaway view schematically showing main parts of a bypass valve in an eighth embodiment.

This eighth embodiment differs from the sixth and seventh embodiments in the structure of the heat-radiation promoting unit. FIG. 12 is a partial cutaway view schematically showing main parts of the bypass valve 1. As shown in FIG. 12, in the present embodiment, differently from the sixth and seventh embodiments, a thick spacer 56 is provided between the first bearing 22 and the first seal member 26, instead of the plate 51 and the spacer 52 used in the sixth and seventh embodiments. The thick spacer 56 is tubular and thicker in thickness in a radial direction than the aforementioned spacer 52, but the thick spacer 56 is out of contact with the outer periphery of the first shaft end portion 14*a*. Specifically, a clearance 57 is formed between the thick spacer 56 and the outer periphery of the first shaft end portion 14*a*. The thick spacer 56 may consist of a slide bearing having a shaft hole with an inner diameter larger than the outer diameter of the first shaft end portion 14*a*. Herein, the first bearing 22 is constantly urged toward the thick spacer 56 by the spring force of the return spring 33 as indicated by arrows in FIG. 12 and thus in contact with the thick spacer 56.

The structure in the present embodiment provides the following operations and advantages in addition to the operations and advantages in the first embodiment. In the present embodiment, specifically, one end face of the first bearing 22 in the axial direction is constantly in contact with the thick spacer 56 over a large area. This configuration increases the amount of heat to be released from the first shaft end portion 14*a* to the main casing 19 through the first bearing 22 and the thick spacer 56. Thus, the heat radiation from the first shaft end portion 14*a* to the main casing 19 is promoted. This promotion of heat radiation further enables reduction in the amount of heat to be transferred from the first shaft end portion 14*a* to the main gear 32 or to the first seal member 26. Accordingly, the the main gear 32 consisting of a resin gear and the first seal member 26 can be further prevented from thermal degradation due to heat damage by EGR gas and can exhibit enhanced heat resistance property.

Ninth Embodiment

Next, a ninth embodiment of an EGR cooler bypass valve embodied as an EGR cooler unit will be described below with reference to the accompanying drawings.

Figure 13:
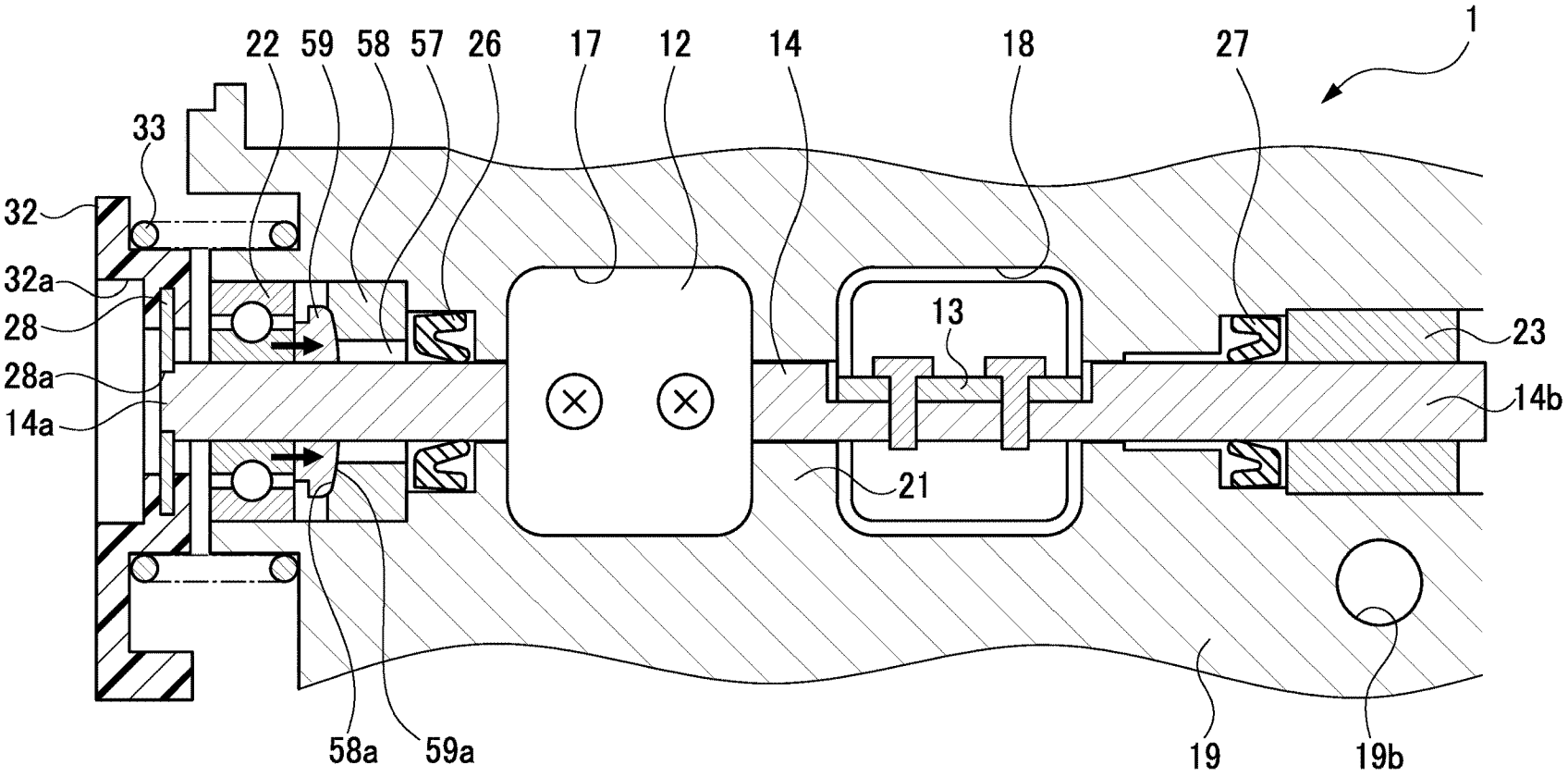
FIG. 13 is a partial cutaway view schematically showing main parts of a bypass valve in a ninth embodiment.

FIG. 13 is a partial cutaway view schematically showing main parts of the bypass valve 1. As shown in FIG. 13, this ninth embodiment differs from the eighth embodiment in that another thick spacer 58 and a rotary plate 59 are provided, instead of the thick spacer 56, between the first bearing 22 and the first seal member 26. The rotary plate 59 has a nearly annular shape and is fixed onto the first shaft end portion 14*a*. One end of the rotary plate 59 in the axial direction contacts one end of the first bearing 22 in the axial direction, while the other end of the rotary plate 59 in the axial direction contacts the end face of the another thick spacer 58. This another thick spacer 58 is shorter in length in the axial direction than the thick spacer 58 in the eighth embodiment and also the clearance 57 between the thick spacer 58 and the first shaft end portion 14*a* is set larger than that in the eighth embodiment. As shown in FIG. 13, the rotary plate 59 and the another thick spacer 58 are in contact with each other through their contact surfaces; one is defined by a convex curved surface 59*a* and the other is defined by a concave curved surface 58*a*. Herein, the first bearing 22 is constantly urged toward the rotary plate 59 by the spring force of the return spring 33 as indicated by arrows in FIG. 13 and thus in contact with the rotary plate 59.

The structure in the present embodiment provides the following operations and advantages in addition to the operations and advantages in the first embodiment. In the present embodiment, specifically, the first shaft end portion 14*a* is constantly in contact with the main casing 19 through the first bearing 22, the rotary plate 59, and the thick spacer 58. This configuration increases the amount of heat to be released from the first shaft end portion 14*a* to the main casing 19 through the first bearing 22, the rotary plate 59, and the another thick spacer 58. Thus, the heat radiation from the first shaft end portion 14*a* to the main casing 19 is promoted. This promotion of heat radiation further enables reduction in the amount of heat to be transferred from the first shaft end portion 14*a* to the main gear 32 and the first seal member 26. Accordingly, the main gear 32 consisting of a resin gear and the first seal member 26 can be prevented from thermal degradation due to heat damage and can exhibit enhanced heat resistance property.

In the present embodiment, the rotary plate 59 and the thick spacer 58 are in contact with each other through their respective convex curved surface 59*a* and concave curved surface 58*a*. Accordingly, even if the first shaft end portion 14*a* somewhat inclines relative to the first bearing 22, the rotary plate 59 and the thick spacer 58 can be reliably brought in contact with each other to enable heat transfer between the rotary plate 59 and the thick spacer 58.

Tenth Embodiment

Next, a tenth embodiment of an EGR cooler bypass valve embodied as an EGR cooler unit will be described below with reference to the accompanying drawings.

Figure 14:
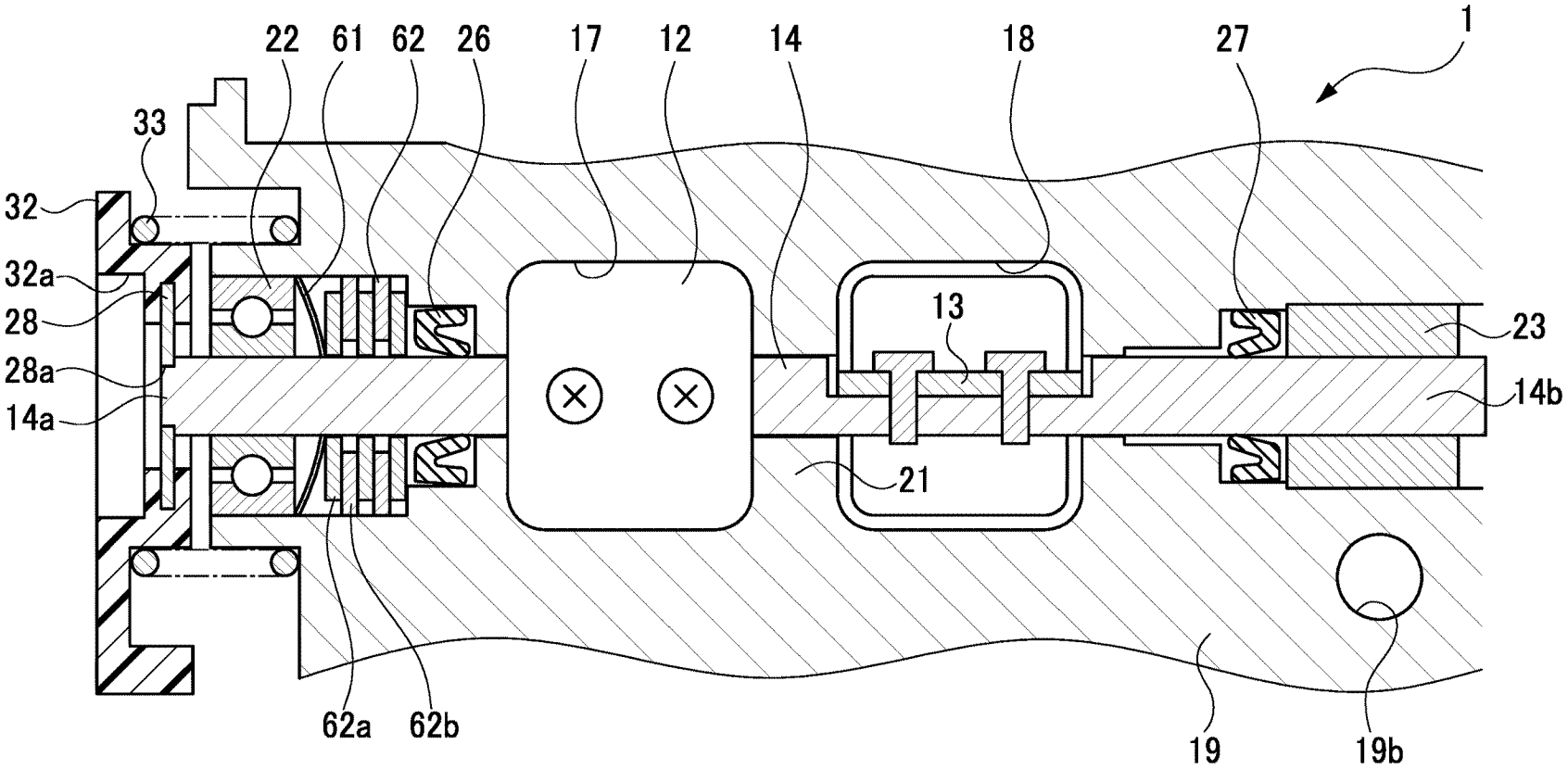
FIG. 14 is a partial cutaway view schematically showing main parts of a bypass valve in a tenth embodiment.

This tenth embodiment differs from the sixth to ninth embodiments in the configuration of the heat-radiation promoting unit. FIG. 14 is a partial cutaway view schematically showing main parts of the bypass valve 1. As shown in FIG. 14, in the present embodiment, a leaf spring 61 and a labyrinth plate 62 are placed in contact with each other in the axial direction of the valve shaft 14 between the first bearing 22 and the first seal member 26. The labyrinth plate 62 consists of a plurality of two types of annular plates 62*a* and 62*b* having different shapes from each other, the plates 62*a* and 62*b* being alternately placed in the axial direction. The leaf spring 61 urges the labyrinth plate 62 in the axial direction to cause the plurality of annular plates 62*a* and 62*b* to contact each other in the axial direction. Of the two types of annular plates 62*a* and 62*b*, the annular plates 62*a* of one type are placed so that their inner peripheries are in contact with the outer periphery of the first shaft end portion 14*a* and their outer peripheries are separated from the main casing 19. In contrast, the annular plates 62*b* of the other type are placed so that their inner peripheries are separated from the outer periphery of the first shaft end portion 14*a* and their outer peripheries are in contact with the main casing 19. With such a configuration, the inner periphery of the labyrinth plate 62 partially contacts the outer periphery of the first shaft end portion 14*a* and the outer periphery of the labyrinth plate 62 partially contacts the main casing 19.

The structure in the present embodiment provides the following operations and advantages in addition to the operations and advantages in the first embodiment. In the present embodiment, specifically, the first shaft end portion 14*a* is constantly in contact with the main casing 19 through the labyrinth plate 62 in addition to the first bearing 22. This configuration increases the amount of heat to be released from the first shaft end portion 14*a* to the main casing 19 through the labyrinth plate 62. Thus, heat radiation from the first shaft end portion 14*a* to the main casing 19 is promoted. This promotion of heat radiation further enables reduction in the amount of heat to be transferred from the first shaft end portion 14*a* to the main gear 32 and to the first seal member 26. Thus, the main gear 32 consisting of a resin gear and the first seal member 26 can be prevented from thermal degradation due to heat damage by EGR gas and can exhibit enhanced heat resistance property.

The present disclosure is not limited to each of the aforementioned embodiments and may be embodied in other specific forms without departing from the essential characteristics thereof.

Figure 15:
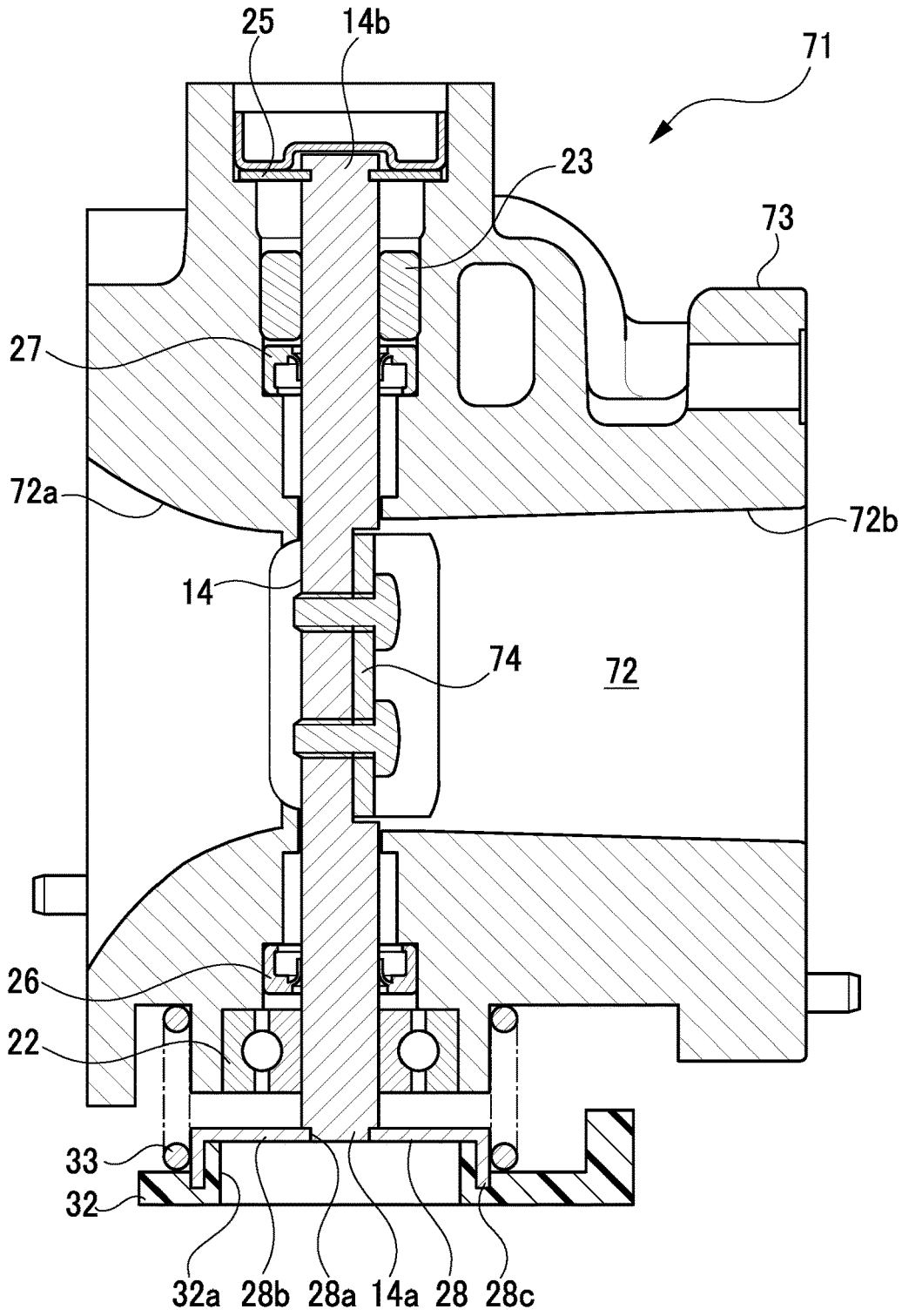
FIG. 15 is a cross-sectional view showing main parts of a bypass valve in another embodiment.
Figure 16:
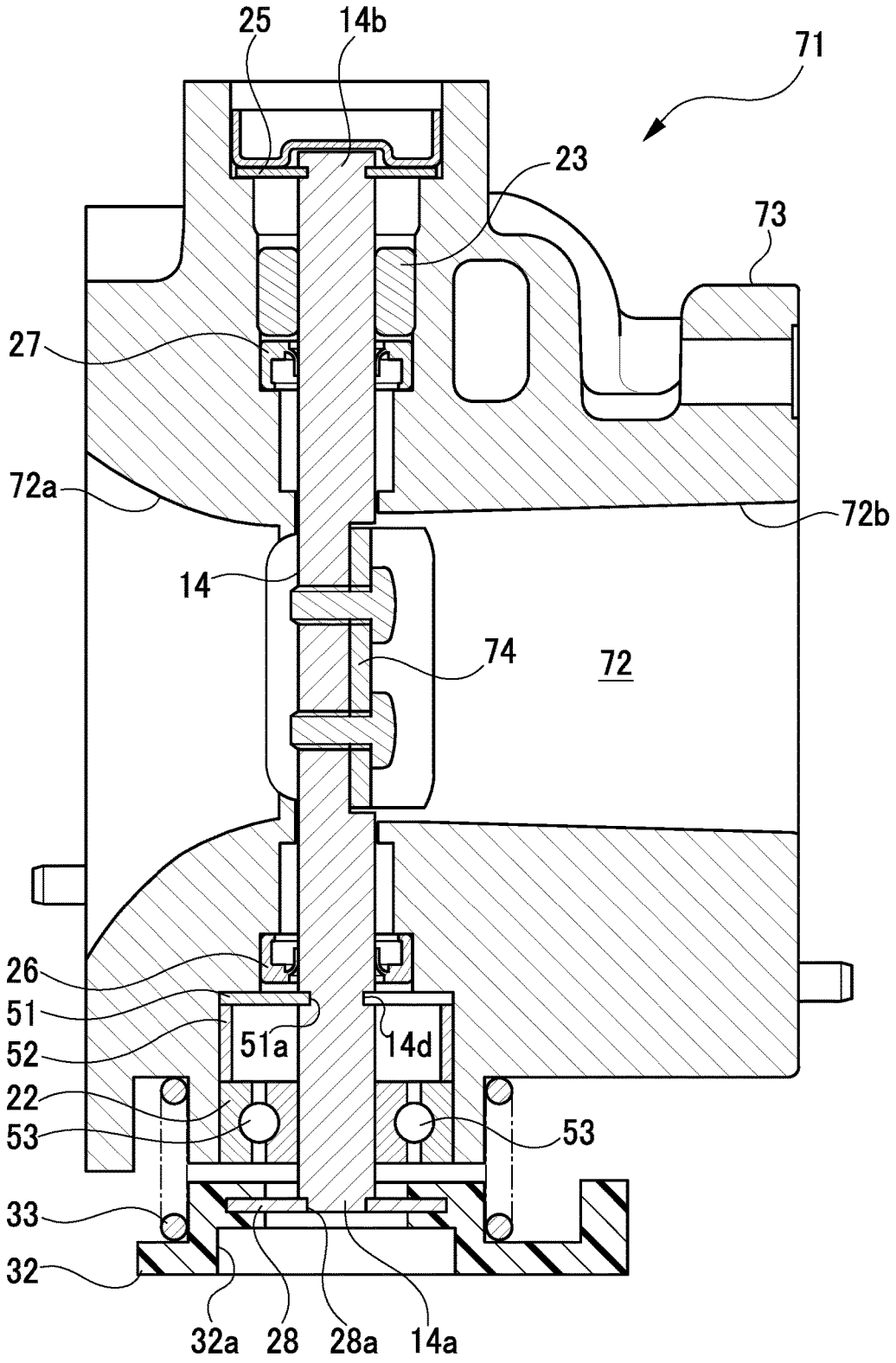
FIG. 16 is a cross-sectional view showing main parts of a bypass valve in another embodiment.

(1) In each of the aforementioned embodiments, the bypass valve in the present disclosure is embodied as the series double-valve type provided in the parallel-flow type EGR cooler unit 2. As alternatives, the bypass valve may also be embodied as a bypass valve of a well-known three-way valve type or a bypass valve provided in a U-shaped flow type EGR cooler unit. For example, FIGS. 15 and 16 are cross-sectional views showing main parts of a bypass valve 71 provided in the U-shaped flow type EGR cooler unit. As is well known, the U-shaped flow type EGR cooler unit is provided with a cooler casing having a U-shaped cooler passage and a bypass passage extending by bypassing the cooler passage. Around the cooler passage, a cooling-water passage is provided to allow engine cooling water to flow therethrough. At one end of the U-shaped cooler passage, an inlet and an outlet are provided adjacent to each other on the same plane. As shown in FIGS. 15 and 16, the bypass valve 71 is provided with a valve casing 73 having a single flow passage 72. This flow passage 72 includes two openings, that is, a first opening 72*a* (a left one in the figure) and second opening 72*b* (a right one in the figure). The first opening 72*a* is communicated with the aforementioned bypass passage, while the second opening 72*b* is communicated with the inlet and the outlet of the cooler passage mentioned above. In this flow passage 72, a single valve element 74 having a plate-like shape is placed to open and close the flow passage 72. The valve element 74 is a butterfly valve element and integrally fixed to the single valve shaft 14. The valve shaft 14 is placed in the valve casing 73 to extend across the flow passage 72 and is rotatably supported through the bearings 22 and 23 placed at both ends of the valve shaft 14. The valve element 74 is fixed to the valve shaft 14 inside the flow passage 72. Further, as shown in FIG. 15, the leading end of the first shaft end portion 14*a* is fixed to the main gear 32. In correspondence with the first bearing 22 (the rolling bearing) rotatably supporting the first shaft end portion 14*a*, a heat-transfer reducing structure may be provided as in the second embodiment. As an alternative, as shown in FIG. 16, in correspondence with the first bearing 22 (the rolling bearing) rotatably supporting the first shaft end portion 14*a*, a heat-radiation promoting unit may be provided as in the sixth embodiment.

(2) In the first and sixth to tenth embodiments, the main gear 32 consists of a resin gear. As an alternative, this main gear may also consist of a metal gear.

(3) The shapes of various parts or components such as the casing and the valve element of the bypass valve in each of the aforementioned embodiments may be changed arbitrarily.

INDUSTRIAL APPLICABILITY

The present disclosure can be utilized in an EGR apparatus provided in an engine.

REFERENCE SIGNS LIST

1 Bypass valve
6 Cooler passage
7 Bypass passage
9 Heat exchanger
11 Valve casing
12 Cooler valve element
13 Bypass valve element
14 Valve shaft
14*a* First shaft end portion
14*b* Second shaft end portion

14*c* Shaft hole (Heat-transfer reducing structure)
151 Speed reducing mechanism
17 Cooler flow passage
18 Bypass flow passage
19 Main casing
21 Partition wall
22 First bearing
23 Second bearing
26 First seal member
27 Second seal member
28 Lever (Metal connecting member)
28*c* Peripheral wall (Heat-transfer reducing structure)
28*d* Arcuate hole (Heat-transfer reducing structure)
32 Main gear (Driven gear, Resin gear)
38 Motor gear
39 Intermediate gear
51 Plate (Heat-radiation promoting unit)
52 Spacer (Heat-radiation promoting unit)
56 Thick spacer (Heat-radiation promoting unit)
58 Thick spacer (Heat-radiation promoting unit)
59 Rotary plate (Heat-radiation promoting unit)
61 Leaf spring (Heat-radiation promoting unit)
62 Labyrinth plate (Heat-radiation promoting unit)
71 Bypass valve
72 Flow passage
73 Valve casing
74 Valve element

What is claimed is:

1. An EGR cooler bypass valve to be used together with an EGR cooler for cooling EGR gas and a bypass passage bypassing the EGR cooler, the EGR cooler bypass valve being configured to simultaneously adjust a flow rate of the EGR gas passing through the EGR cooler and a flow rate of the EGR gas passing through the bypass passage, the EGR cooler bypass valve including:

a casing including a cooler flow passage through which the EGR gas having passed through the EGR cooler flows, and a bypass flow passage through which the EGR gas having passed through the bypass passage flows, the casing being configured such that the cooler flow passage and the bypass flow passage are separated by a partition wall;

a valve shaft placed in the casing so that the valve shaft extends across the cooler flow passage, the bypass flow passage, and the partition wall, and the valve shaft including a first shaft end portion and a second shaft end portion;

a cooler valve element placed in the cooler flow passage and provided integral with the valve shaft;

a bypass valve element placed in the bypass flow passage and provided integral with the valve shaft;

a first bearing provided between the casing and the first shaft end portion and configured to rotatably support the first shaft end portion;

a second bearing provided between the casing and the second shaft end portion and configured to rotatably support the second shaft end portion;

a first seal member placed near the first bearing and configured to seal between the first shaft end portion and the casing;

a second seal member placed near the second bearing and configured to seal between the second shaft end portion and the casing; and a driven gear fixed to a leading end of the first shaft end portion to rotate the valve shaft, the driven gear constituting a speed reducing mechanism, the EGR cooler bypass valve being configured to rotate the valve shaft through the driven gear to open and close the cooler valve element and the bypass valve element, wherein the cooler flow passage and the cooler valve element are placed adjacent to the first shaft end portion and the bypass flow passage and the bypass valve element are placed adjacent to the second shaft end portion, the first bearing consists of a rolling bearing to precisely support rotation of the first shaft end portion, and the second bearing consists of a slide bearing to enhance heat radiation from the second shaft end portion to the casing.

2. The EGR cooler bypass valve according to claim 1, wherein the driven gear consisting of a resin gear, a metal connecting member is integrally provided in the resin gear, the leading end of the first shaft end portion is connected to the resin gear through the metal connecting member, and the metal connecting member is provided with a heat-transfer reducing structure for reducing heat transfer from the first shaft end portion to the resin gear.

3. The EGR cooler bypass valve according to claim 1, wherein the EGR cooler bypass valve includes a heat-radiation promoting unit placed on the first shaft end portion and between the first bearing and the first seal member to promote heat radiation from the first shaft end portion to the casing.

* * * * *